US011560668B2

(12) United States Patent
Kwon et al.

(10) Patent No.: US 11,560,668 B2
(45) Date of Patent: Jan. 24, 2023

(54) LAUNDRY TREATING APPARATUS

(71) Applicant: LG ELECTRONICS INC., Seoul (KR)

(72) Inventors: Yongwoo Kwon, Seoul (KR); Yeongkyeong Choi, Seoul (KR); Gyuri Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 323 days.

(21) Appl. No.: 16/776,779

(22) Filed: Jan. 30, 2020

(65) Prior Publication Data

US 2020/0248394 A1 Aug. 6, 2020

(30) Foreign Application Priority Data

Feb. 1, 2019 (KR) ..... 10-2019-0014062
Oct. 8, 2019 (KR) ..... 10-2019-0124785

(51) Int. Cl.
*D06F 39/14* (2006.01)
*D06F 58/20* (2006.01)

(52) U.S. Cl.
CPC ..... *D06F 39/14* (2013.01); *D06F 58/20* (2013.01)

(58) Field of Classification Search
CPC ..... D06F 39/08; D06F 39/14; D06F 58/20
USPC ..... 68/196
See application file for complete search history.

(56) References Cited

U.S. PATENT DOCUMENTS

| | | | |
|---|---|---|---|
| 6,256,823 | B1 | 7/2001 | Kronbetter et al. |
| 8,148,633 | B2 | 4/2012 | Hung |
| 8,555,681 | B2 | 10/2013 | Caudevilla De Sola et al. |
| 8,570,737 | B2 | 10/2013 | Rayner |
| 2004/0177656 | A1 | 9/2004 | Kwon |
| 2005/0034486 | A1 | 2/2005 | Bienick et al. |
| 2005/0138974 | A1* | 6/2005 | Ha ..... D06F 37/28 68/3 R |
| 2005/0262681 | A1 | 12/2005 | Yoon |
| 2006/0117813 | A1 | 6/2006 | Ha et al. |
| 2006/0218975 | A1 | 10/2006 | Graute et al. |
| 2007/0051012 | A1 | 3/2007 | Schoene |
| 2007/0125132 | A1 | 6/2007 | Hwang |
| 2007/0137261 | A1 | 6/2007 | Kwon |

(Continued)

FOREIGN PATENT DOCUMENTS

| | | |
|---|---|---|
| CN | 1475621 | 2/2004 |
| CN | 1607290 | 4/2005 |

(Continued)

OTHER PUBLICATIONS

CN104975466A—machine translation (Year: 2015).*

(Continued)

*Primary Examiner* — Tinsae B Ayalew
(74) *Attorney, Agent, or Firm* — Ked & Associates

(57) ABSTRACT

A laundry treating apparatus may include a main body having with a laundry inlet port at a front surface thereof; a door rotatably coupled to the front surface of the main body to open and close the laundry inlet port; a front glass installed at a front surface of the door; a handle installed at a rear surface of the door, so as to face in a direction opposite to the front glass. The handle may be inclined with respect to a vertical plane of the front glass, so as to prevent fingers from sliding outward on the rear surface of the door.

15 Claims, 14 Drawing Sheets

(56) References Cited

U.S. PATENT DOCUMENTS

| | | | | |
|---|---|---|---|---|
| 2007/0240456 | A1 | 10/2007 | Byun et al. | |
| 2008/0223085 | A1 | 9/2008 | Park | |
| 2008/0302141 | A1 | 12/2008 | Chung | |
| 2009/0165391 | A1 | 7/2009 | Kocak et al. | |
| 2011/0025178 | A1* | 2/2011 | Schone | D06F 39/14 312/228 |
| 2011/0050059 | A1* | 3/2011 | Kim | D06F 39/14 312/228 |
| 2015/0000200 | A1* | 1/2015 | Jung et al. | D06F 39/14 49/460 |
| 2015/0003027 | A1 | 1/2015 | Han et al. | |
| 2016/0369445 | A1 | 12/2016 | Kim et al. | |
| 2017/0121884 | A1 | 5/2017 | Kwon et al. | |
| 2017/0121889 | A1 | 5/2017 | Kwon et al. | |
| 2017/0121890 | A1 | 5/2017 | Kwon et al. | |
| 2017/0167070 | A1 | 6/2017 | Khamprachom et al. | |
| 2017/0183803 | A1 | 6/2017 | Kim et al. | |
| 2017/0260678 | A1 | 9/2017 | Wee et al. | |
| 2018/0002853 | A1 | 1/2018 | Anand et al. | |
| 2018/0163333 | A1 | 6/2018 | Zhang et al. | |
| 2018/0195226 | A1 | 7/2018 | Kwon et al. | |
| 2018/0216282 | A1 | 8/2018 | Lee et al. | |
| 2018/0274155 | A1 | 9/2018 | Anand et al. | |
| 2018/0363198 | A1 | 12/2018 | Gim | |
| 2019/0071815 | A1 | 3/2019 | Woodham, Jr. et al. | |

FOREIGN PATENT DOCUMENTS

| | | |
|---|---|---|
| CN | 1880559 | 12/2006 |
| CN | 1940167 | 4/2007 |
| CN | 101074531 | 11/2007 |
| CN | 101671930 | 3/2010 |
| CN | 104372569 | 2/2015 |
| CN | 104420137 | 3/2015 |
| CN | 204311247 | 5/2015 |
| CN | 104975466 | 10/2015 |
| CN | 204780322 | 11/2015 |
| CN | 105937137 | 9/2016 |
| CN | 106012423 | 10/2016 |
| CN | 106032611 | 10/2016 |
| CN | 106133231 | 11/2016 |
| CN | 205907515 | 1/2017 |
| CN | 107287850 | 10/2017 |
| CN | 107541888 | 1/2018 |
| CN | 107641942 | 1/2018 |
| CN | 107974810 | 5/2018 |
| CN | 108796966 | 11/2018 |
| CN | 208293271 | 12/2018 |
| CN | 109112795 | 1/2019 |
| DE | 29721320 | 2/1998 |
| DE | 20 2012 101253 | 4/2013 |
| DE | 20 2014 010 568 | 2/2016 |
| EP | 0 870 861 | 10/1998 |
| EP | 1 262 589 | 12/2002 |
| EP | 1 522 623 | 4/2005 |
| EP | 1 309 749 | 12/2005 |
| EP | 1 860 228 | 11/2007 |
| EP | 2 147 996 | 1/2010 |
| EP | 2 161 364 | 3/2010 |
| EP | 2 677 076 | 12/2013 |
| EP | 3 112 524 | 1/2017 |
| EP | 2 740 833 | 4/2017 |
| EP | 3 162 945 | 5/2017 |
| EP | 3 181 750 | 6/2017 |
| EP | 3 332 060 | 6/2018 |
| EP | 3 363 945 | 8/2018 |
| EP | 3 875 670 | 9/2021 |
| FR | 2691298 | 11/1993 |
| FR | 2 733 258 | 10/1996 |
| FR | 2756575 | 6/1998 |
| GB | 2118580 | 11/1983 |
| GB | 2320507 | 6/1998 |
| IT | VR20120061 | 9/2017 |
| JP | H06-31766 | 4/1994 |
| JP | H10-24130 | 1/1998 |
| JP | 2000-145022 | 5/2000 |
| JP | 2005-058771 | 3/2005 |
| JP | 2005-160952 | 6/2005 |
| JP | 2008-295957 | 12/2008 |
| JP | 2010-063522 | 3/2010 |
| JP | 2012-075689 | 4/2012 |
| JP | 2012-223344 | 11/2012 |
| JP | 2014-003293 | 1/2014 |
| JP | 2014-151948 | 8/2014 |
| JP | 2016-049112 | 4/2016 |
| JP | 2017-038828 | 2/2017 |
| JP | 2017-099993 | 6/2017 |
| JP | 2018-514346 | 6/2018 |
| JP | 2018-110645 | 7/2018 |
| JP | 2018-531753 | 11/2018 |
| JP | 2018-532545 | 11/2018 |
| JP | 2018-536517 | 12/2018 |
| KR | 10-2004-0011219 | 2/2004 |
| KR | 10-0465148 | 1/2005 |
| KR | 2005-0021057 | 3/2005 |
| KR | 10-0595180 | 6/2006 |
| KR | 10-2007-0002458 | 1/2007 |
| KR | 10-2007-0044599 | 4/2007 |
| KR | 20070070780 A * | 7/2007 |
| KR | 10-2010-0019091 | 2/2010 |
| KR | 10-2010-0042984 | 4/2010 |
| KR | 10-2011-0013011 | 2/2011 |
| KR | 10-2011-0028899 | 3/2011 |
| KR | 10-1138697 | 6/2012 |
| KR | 10-1156707 | 6/2012 |
| KR | 10-2014-0006647 | 1/2014 |
| KR | 10-2015-0003592 | 1/2015 |
| KR | 10-2015-0006264 | 1/2015 |
| KR | 10-2016-0041886 | 4/2016 |
| KR | 10-1708350 | 2/2017 |
| KR | 10-1708351 | 2/2017 |
| KR | 10-1708352 | 2/2017 |
| KR | 10-1708355 | 2/2017 |
| KR | 10-2018-0089992 | 8/2018 |
| KR | 10-2018-0136086 | 12/2018 |
| KR | 10-2018-0136094 | 12/2018 |
| KR | 10-2018-0136095 | 12/2018 |
| KR | 10-2018-0136102 | 12/2018 |
| RU | 2355836 | 5/2009 |
| WO | WO 2015/144236 | 10/2015 |
| WO | WO 2017/020959 | 2/2017 |
| WO | WO 2018/001160 | 1/2018 |
| WO | WO 2018/077130 | 5/2018 |
| WO | WO 2018/121942 | 7/2018 |
| WO | WO 2018/138946 | 8/2018 |

OTHER PUBLICATIONS

KR20070070780A—machine translation (Year: 2007).*

European Search Report dated Jun. 24, 2020 issued in EP Application No. 20152188.7.

European Search Report dated Jun. 24, 2020 issued in EP Application No. 20152181.2.

European Search Report dated Jun. 24, 2020 issued in EP Application No. 20152156.4.

European Search Report dated Jul. 1, 2020 issued in EP Application No. 20152169.7.

European Search Report dated Jul. 7, 2020 issued in EP Application No. 20152158.0.

Korean Office Action dated Jul. 23, 2020 issued in KR Application No. 10-2019-0058241.

Russian Notice of Allowance dated Aug. 25, 2020 issued in RU Application No. 2020103247.

Australian Office Action dated Sep. 2, 2020 issued in AU Application No. 2020200550.

Japanese Office Action dated Dec. 15, 2020 issued in JP Application No. JP 2020-013134.

Japanese Office Action dated Dec. 15, 2020 issued in JP Application No. JP 2020-013137.

Japanese Office Action dated Feb. 2, 2021 issued in JP Application No. JP 2020-013079.

(56) References Cited

OTHER PUBLICATIONS

Australian Office Action dated Sep. 17, 2020 issued in AU Application No. 2020200522.
European Search Report dated Jun. 29, 2020 issued in Application No. 20152175.4.
Korean Office Action dated Jun. 15, 2021 issued in KR Application No. 10-2019-0124785.
Russian Office Action issued in Application No. 2020200539 dated Jun. 11, 2020.
European Search Report issued in Application No. 20152173.9 dated Jul. 1, 2020.
Australian Office Action issued in Application No. 2020102680/03 dated Aug. 17, 2020.
Japanese Office Action dated Mar. 2, 2021 issued in JP Application No. 2020-013080.
Australian Office Action dated Apr. 1, 2021 issued in AU Application No. 2020200550.
U.S. Office Action dated Dec. 15, 2021 issued in U.S. Appl. No. 16/776,820.
Russian Notice of Allowance dated May 25, 2020 issued in RU Application No. 2020102678.
European Search Report dated Jul. 1, 2020 issued in EP Application No. 20152172.1.
Australian Examination Report dated Aug. 17, 2020 issued in Application No. 2020200534.
U.S. Appl. No. 16/776,709, filed Jan. 30, 2020.
Russian Notice of Allowance dated Apr. 21, 2020 issued in RU Application No. 2020103239.
Russian Notice of Allowance dated May 15, 2020 issued in RU Application No. 2020103240.
Russian Office Action dated Jun. 18, 2020 issued in RU Application No. 2020103247.
International Search Report dated May 18, 2020 issued in PCT Application No. PCT/KR2020/001531.
Korean Office Action dated Jun. 15, 2021 issued in KR Application No. 10-2019-0127328.
Korean Office Action dated Jun. 15, 2021 issued in KR Application No. 10-2019-0127330.
Korean Office Action dated Jun. 15, 2021 issued in KR Application No. 10-2019-0127998.
Korean Office Action dated Jun. 15, 2021 issued in KR Application No. 10-2020-0011873.
Korean Office Action dated Jun. 15, 2021 issued in KR Application No. 10-2019-0058251.
Korean Office Action dated Jun. 15, 2021 issued in KR Application No. 10-2019-0060211.
United States Office Action dated Jan. 14, 2022 issued in co-pending related U.S. Appl. No. 16/776,695.
United States Office Action dated Jan. 24, 2022 issued in co-pending related U.S. Appl. No. 16/776,739.
Japanese Office Action dated Feb. 2, 2021 issued in JP Application No. 2020-012212.
Chinese Office Action dated Mar. 3, 2022 issued in CN Application No. 201911291955.6.
Chinese Office Action dated Mar. 4, 2022 issued in CN Application No. 201911338352.7.
Chinese Office Action dated Mar. 8, 2022 issued in CN Application No. 201911356949.4.
Chinese Office Action dated Mar. 17, 2022 issued in CN Application No. 201911338904.4.
Chinese Office Action dated Mar. 21, 2022 issued in CN Application No. 201911265766.1.
Chinese Office Action dated Apr. 2, 2022 issued in CN Application No. 201911356952.6.
German Office Action dated Apr. 8, 2022 issued in DE Application No. 102020100945.3.
U.S. Office Action issued in U.S. Appl. No. 16/776,780 dated May 24, 2022.
Chinese Office Action issued in Application No. 201911356954.5 dated May 7, 2022.
U.S. Appl. No. 16/776,624, filed Jan. 30, 2020.
U.S. Appl. No. 16/776,639, filed Jan. 30, 2020.
U.S. Appl. No. 16/776,683, filed Jan. 30, 2020.
U.S. Appl. No. 16/776,695, filed Jan. 30, 2020.
U.S. Appl. No. 16/776,739, filed Jan. 30, 2020.
U.S. Appl. No. 16/776,780, filed Jan. 30, 2020.
U.S. Appl. No. 16/776,779, filed Jan. 30, 2020.
U.S. Appl. No. 16/776,820, filed Jan. 30, 2020.

* cited by examiner

LAUNDRY TREATING APPARATUS

CROSS-REFERENCE TO RELATED APPLICATION(S)

Pursuant to 35 U.S.C. § 119(a), this application claims the benefit of the earlier filing date and the right of priority to Korean Patent Applications No. 10-2019-0014062, filed in Korea on Feb. 1, 2019, and No. 10-2019-0124785, filed in Korea on Oct. 8, 2019, the contents of which are incorporated by reference herein in their entirety.

BACKGROUND

1. Field

A laundry treating apparatus having a door that opens and closes a laundry inlet port is disclosed herein.

2. Background

In general, a laundry treating apparatus may include an apparatus having a function of washing or drying laundry or other items (hereinafter, collectively "laundry"). In addition, the laundry treating apparatus may be configured to have both a washing function and a drying function of the laundry.

The laundry treating apparatus may include a main body having a laundry inlet port, a door configured to open and close the laundry inlet port. Recently, there has been increasing need to install a circular front glass on a front surface of the door in order to give a luxurious feel to the laundry treating apparatus while letting users see inside of the laundry inlet port. However, when the circular front glass is provided on the front surface of the door, due to a nature of the glass material, the front glass is easily broken when a hole is drilled in the front glass, making it difficult to install a handle.

In order to solve this problem, the front glass is installed on a front surface of a door frame, and a handle is installed on a rear surface of the door frame made of a plastic material, which is more suitable for installing the handle, in a direction opposite to the front glass. However, when a user pulls the handle installed on the rear surface of the door frame, fingers (or hands) may easily slip off the handle. In addition, the handle feels cold to the touch when it gets cold due to heat transferred from the door frame, which gives an uncomfortable feeling to the user when holding the handle.

BRIEF DESCRIPTION OF THE DRAWINGS

Embodiments will be described in detail with reference to the following drawings in which like reference numerals refer to like elements, and wherein.

DETAILED DESCRIPTION

Figure 1:
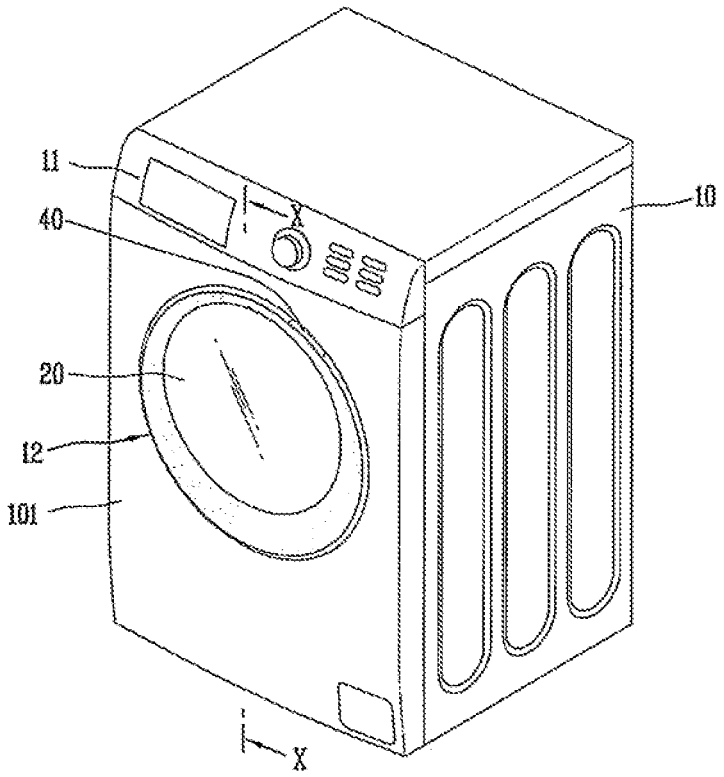
FIG. 1 is a perspective view of a laundry treating apparatus according to an embodiment.

Hereinafter, embodiments will be described with reference to the accompanying drawings. In the drawings, the same or similar elements are designated with the same or similar reference numerals, and redundant description has been omitted. The suffixes "module" and "unit" for components or elements used in the following description are given or mixed in consideration of ease in creating specification, and do not have distinct meanings or roles. In describing embodiments, if a detailed explanation for a related known technology or construction is considered to unnecessarily divert the gist, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second may be used to describe various elements, but the elements are not limited by the terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

Singular expressions include plural expressions unless the context clearly indicates otherwise.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, elements, components or combinations thereof are not excluded in advance.

FIG. 1 is a perspective view of a laundry treating apparatus according to an embodiment. The laundry treating apparatus disclosed herein may include a main body 10, a laundry accommodating portion, and a door 12. The main body 10 may define an outer shape or appearance of the laundry treating apparatus. The main body 10 may be defined in a rectangular parallelepiped shape.

The main body 10 may include a front panel 101, a rear panel, side panels, an upper panel, and a lower panel. The front panel 101 may define a front surface of the laundry treating apparatus. The rear panel may define a rear surface of the laundry treating apparatus. The side panels may define left and right or lateral sides of the laundry treating apparatus, respectively. The upper panel may define an upper surface of the laundry treating apparatus. The lower panel may define a lower surface of the laundry treating apparatus. A laundry inlet port 106 (see FIG. 10) may be formed in the front panel 101. The rear panel and the side panels may be defined in a "c" shape by bending one rectangular plate, thereby improving a structural rigidity of the main body 10.

The laundry inlet port 106 formed in a circular shape may be provided at the front panel 101. The door 12 may be rotatably coupled to the front panel 101 by a hinge 25 (see FIG. 3), so as to open and close the laundry inlet port 106.

A laundry accommodating portion may be provided inside of the main body 10. The laundry accommodating portion may be provided with a drum to perform a drying function. The laundry accommodating portion may include a tub and a drum to perform washing and drying functions together.

For example, in order to perform the washing and drying functions together, a tub and a drum may be provided inside of the main body 10. The tub may be defined in a cylindrical shape. The tub may be disposed such that a central axis of the tub is horizontal or inclined at a predetermined angle in a lengthwise direction of the tub. Wash water may be stored inside of the tub.

A gasket may be provided at a front end portion or end of the tub to communicate with the laundry inlet port 106, thereby preventing the wash water stored inside of the tub from leaking into an accommodation space of the main body 10.

The drum may be provided in the tub to be rotatable with respect to the tub. A front portion of the drum may be open to be in communication with the laundry inlet port 106, and laundry may be introduced inside of the drum through the laundry inlet port 106.

A drive motor may be installed on a rear surface of the tub. The drive motor may be connected to the rear surface of the drum by a rotational shaft. As the drive motor is driven, power of the drive motor may be transmitted to the drum through the rotational shaft, thereby rotating the drum.

The drum may be provided with a plurality of lifters therein to rotate laundry accommodated inside of the drum, thereby performing washing and drying functions. For example, when the plurality of lifters rotate along with the drum so as to spin the laundry from a bottom to a top of the drum along an inner circumferential surface of the drum, the laundry may fall to the bottom of the drum due to gravity, thereby acquiring an effect of washing dirty laundry by beating the laundry with a paddle.

A plurality of through holes may be formed through a circumferential surface of the drum to allow a fluid, such as wash water, to flow into and out of the drum through the plurality of through holes.

A controller 11 is configured to display information related to operations of the laundry treating apparatus to a user and to receive the user's input. The controller 11 may include a display for displaying visual information. The controller 11 may also include a circular knob and a plurality of buttons for receiving the user's input, for example.

The controller 11 may be provided on the main body 10 or provided on the door 12. In this embodiment, controller 11 is located on an upper portion of the front panel 101 of the main body 10.

Figure 2:
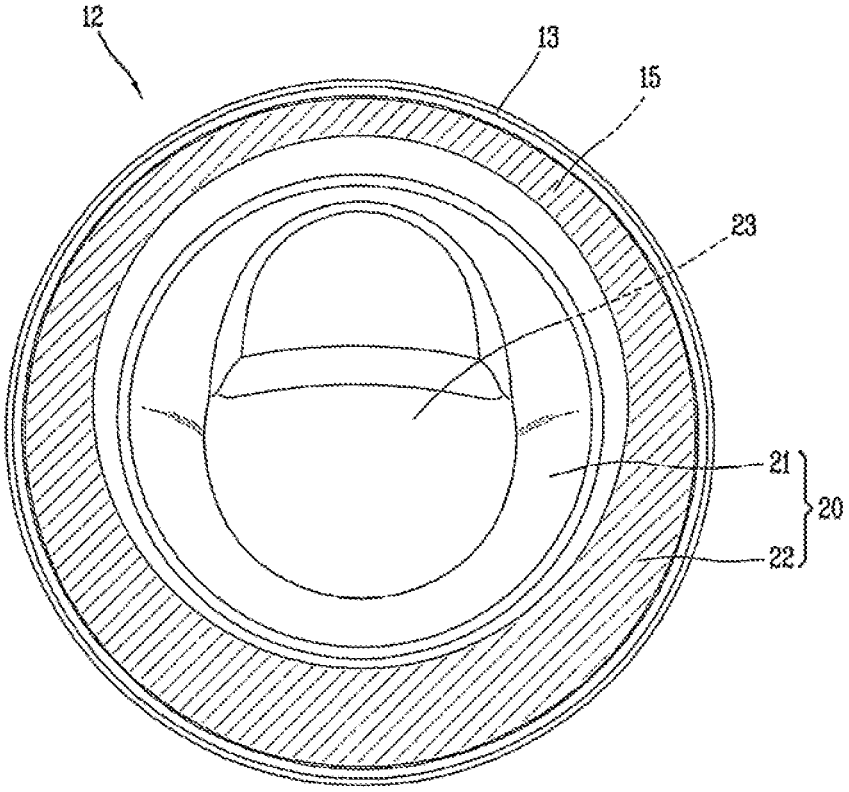
FIG. 2 is a front view of a door in FIG. 1.
Figure 3:
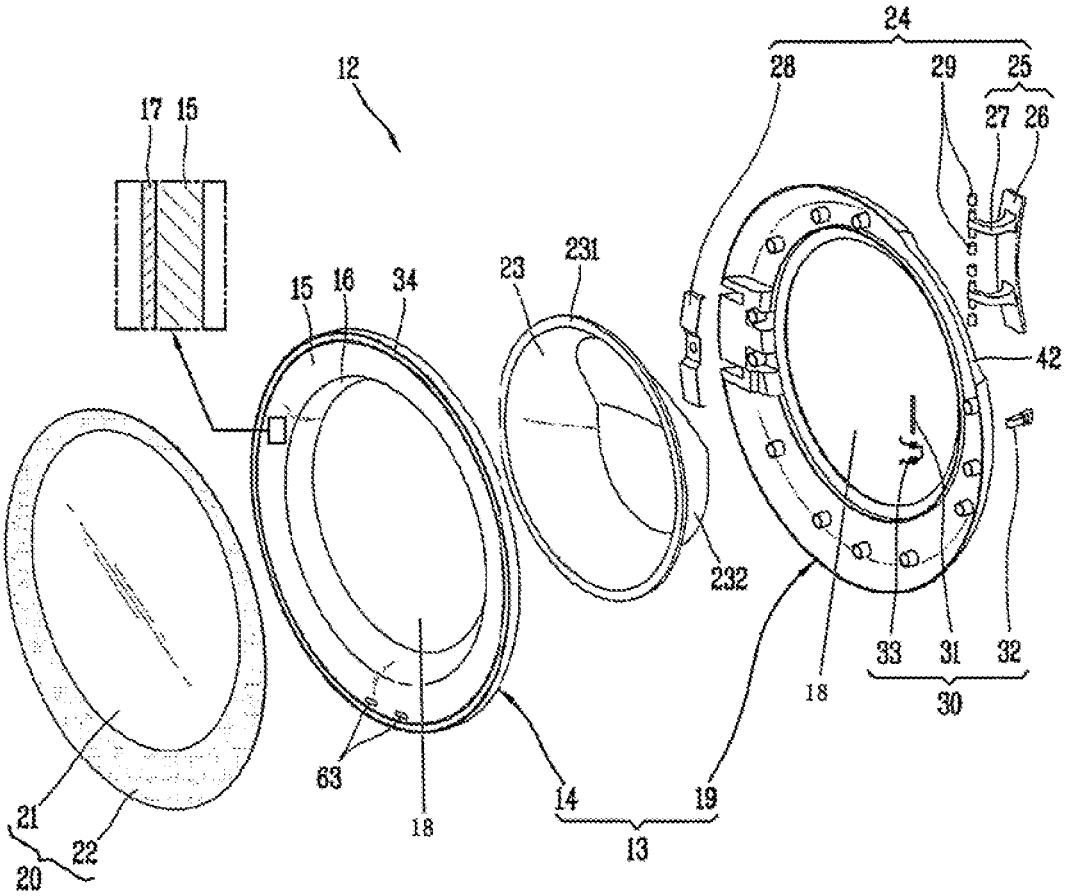
FIG. 3 is an exploded view of the door in FIG. 2.

FIG. 2 is a front view of the door 12 in FIG. 1. FIG. 3 is an exploded view of the door 12 of FIG. 2.

The door 12 may include a door frame 13, a door window 23, a front glass 20, a hinge unit 24, and a locking unit 30. The door frame 13 may have a ring shape.

The door frame 13 may include an outer frame 14 and an inner frame 19. The outer frame 14 and the inner frame 19 may be made of a synthetic resin material, such as an acrylonitrile butadiene styrene (ABS) material, or a polycarbonate (PC) material, for example. Each of the outer frame 14 and the inner frame 19 may be manufactured by injection molding, for example, when made of a synthetic resin material.

The outer frame 14 and the inner frame 19 may each have a ring shape, each having a diameter that corresponds to each other, and coupled to each other in an overlapping manner in a frontward-rearward direction. Each of the outer frame 14 and the inner frame 19 may be provided with a hook 36 (see FIG. 13) at an outer circumference thereof to be engaged with each other by, for example, an interference or snap fit.

The outer frame 14 and the inner frame 19 are named as such as the outer frame 14 is disposed toward or faces an outside of the main body 10 and the inner frame 19 is disposed toward or faces an inside of the main body 10 based on a state in which the door 12 is closed. The outer frame 14 may be referred to as a "first frame", and the inner frame 19 may be referred to as a "second frame".

A circular opening 18 may be formed inside of each of the outer frame 14 and the inner frame 19. The openings 18 may be eccentrically positioned from centers of the outer frame 14 and the inner frame 19, respectively. For example, a center of the opening 18 may be positioned above the center of each of the outer frame 14 and the inner frame 19.

According to this embodiment, each of the outer frame 14 and the inner frame 19 may vary in width along a circumferential direction. In other words, a distance (width) between an outer diameter and an inner diameter (the opening 18 diameter) of each of the outer frame 14 and the inner frame 19 may increase (widen) from a top end to a bottom end.

A center of the drum may be disposed higher than a center of a height (½) of the main body 10. The drum may be fixed in a heightwise direction of the main body 10 aside from minute vibration due to rotation.

Consumers tend to prefer a larger size of the door 12 to a same capacity and size of the washing machine when looking at the body 10 from the front. In addition, consumers are able to look into the drum through the door 12, and if possible, prefer to have a wide field of view with regard to an inner space of the drum.

In order to satisfy the needs of the above-mentioned consumers, the door 12 must be enlarged downward to increase the size of the door 12 while a position of the drum is fixed. A center of the door frame 13 must move below a center of the laundry inlet port 106 or the opening 18. Similarly, the center of the door frame 13 may move downward with respect to the door window 23 positioned to correspond to the opening 18.

In addition, in order to enlarge the size of the door 12, a portion of the door 12 may protrude outward from the recess 103, and a diameter of the door 12 may be large. For example, a portion of the door protruding outward from the recess 103 may include a portion of a mounting guide, a flat portion, and a curved portion, which are part of the outer frame 14.

The front glass 20 may be defined in a complete circular shape having a predetermined radius. The front glass 20 may be made of a glass material. Further, the front glass 20 may have flat front and rear surfaces.

The front glass 20 may have a disc shape having a predetermined thickness, without bending, when viewed from any direction, up, down, left, or right. As described above, the front and rear surfaces of the front glass 20 made of a glass material may have a flat complete circular shape, thereby enhancing a quality grade of the door 12, compared to a door cover in the related art made of a synthetic resin material and having a convex front surface in an incomplete circular shape.

The front glass 20 may cover the opening 18 of the door frame 13. The front glass 20 may be bonded to a front surface of the outer frame 14 by a sealant or an adhesive, for example.

Due to a nature of the glass material, it is easy to break when a fastening hole is drilled in the front glass 20, and thus, the front glass 20 may be attached to the outer frame 14 using an adhesive, for example, to prevent the glass from being broken. On the other hand, the front glass 20 made of a glass material occupies a relatively large load compared to a total load of the door 12. In order to support the load of the front glass 20, a mounting guide 34 to mount the front glass 20 may be provided on a front surface of the outer frame 14.

In particular, the front glass 20 may be made of tempered glass. Due to a nature of tempered glass, front and rear surfaces of the front glass 20 have a high strength, but a circular outer circumferential surface, which is a side surface of the front glass 20, has a low strength. To compensate for this, the mounting guide 34 may be disposed to protrude forward from a front outer circumferential end of the outer frame 14 to surround an outer circumferential surface of the front glass 20, to support the load of the front glass 20 as well as to protect a side or outer circumferential surface of the front glass 20 from an external shock or impact.

A protruding length of the mounting guide 34 may cover at least ⅔ of the thickness of the front glass 20. This is because an external impact may be applied to the outer circumferential surface of the front glass 20 and the load of the front glass 20 may not be sufficiently supported when the protruding length of the mounting guide 34 is too short.

Figure 14:
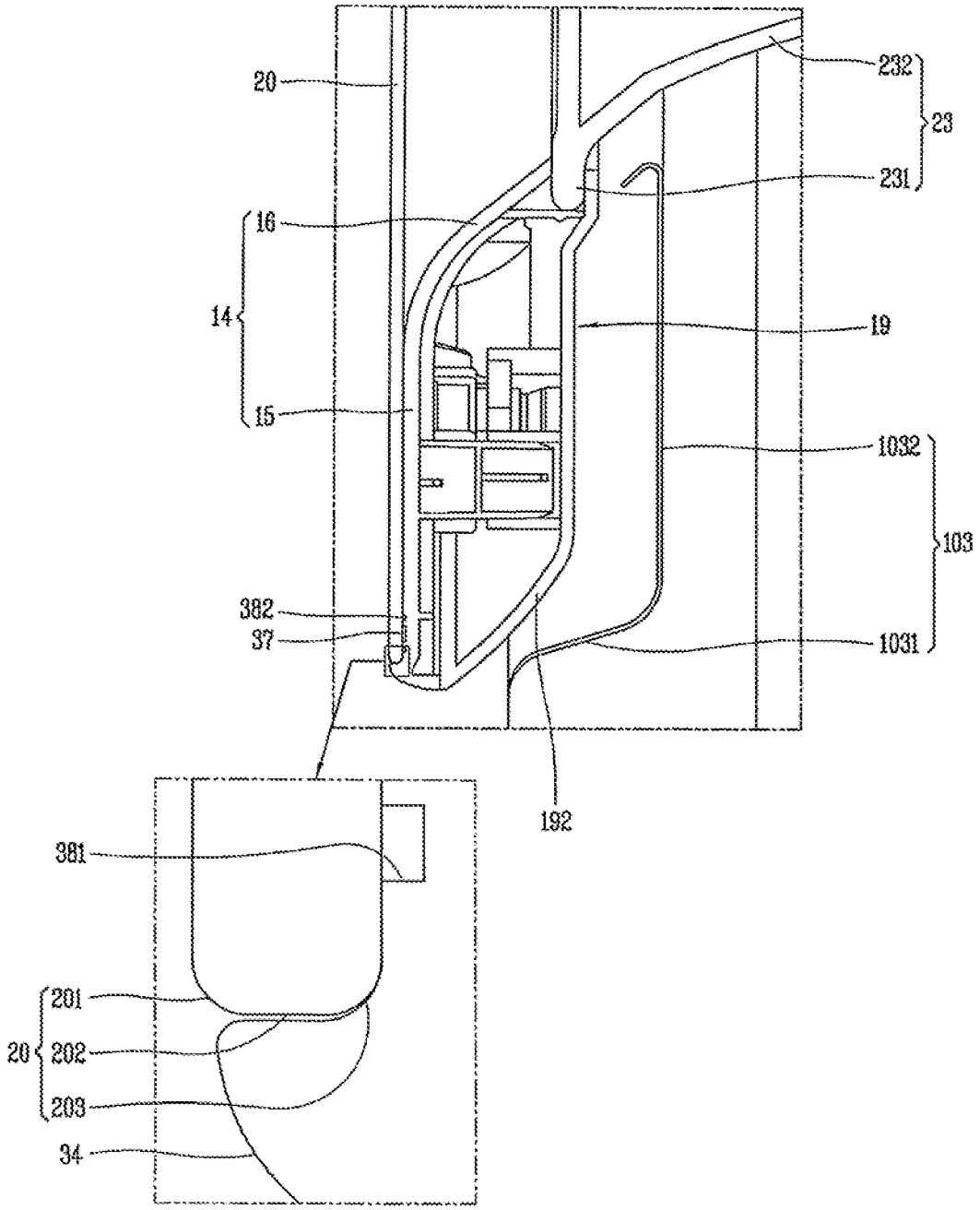
FIG. 14 is an enlarged cross-sectional view illustrating a portion "XIV" in FIG. 10, in which a non-contact portion is spaced apart from the recess of the main body.

For example, a straight portion 202 and a plurality of curved portions 201, 203 may be defined on the outer circumferential surface of the front glass 20, as shown in FIG. 14. The plurality of curved portions 201, 203 may include first curved portion 201 connected to a front surface of the front glass 20 and second curved portion 203 connected to a rear surface of the front glass 20. The straight portion 202 may extend between the first and second curved portions 201, 203 and be connected to the plurality of curved portions 201, 203, respectively. Each of the first curved portion 201, the straight portion 202, and the second curved portion 203 may be ⅓ of the thickness of the front glass 20.

The mounting guide 34 may cover the second curved portion 203 and the straight portion 202 of the front glass 20. The mounting guide 34 may protrude from a front edge portion or edge of the outer frame 14. The mounting guide 34 may extend in a ring shape to define a space in which the front glass 20 may be accommodated.

The mounting guide 34 may surround the outer circumferential surface of the front glass 20. The mounting guide 34 may have a predetermined inner diameter and be completely circular. An inner diameter of the mounting guide 34 may correspond to an outer diameter of the front glass 20.

A transparent region 21 and a non-transparent region 22 may be disposed at inner and outer sides of the front glass 20, respectively. The transparent region 21 denotes a region configured to transmit at least a portion of light so that an opposite side or the inside of the laundry accommodating portion may be viewed by the user. Therefore, the transparent region 21 may include a translucent region 21.

The transparent region 21 may correspond to the opening 18 of the outer frame 14, the opening 18 of the inner frame 19, and the door window 23. Therefore, when the door 12 is closed, the user may look into the laundry accommodating portion through the transparent region 21.

A center of the transparent region 21 may be located at a position corresponding to a center of the opening 18 of each of the outer frame 14 and the inner frame 19. The corresponding position may include not only perfect alignment of the center, but also, alignment in an eccentric direction of the center. In other words, the center of the transparent region 21 and the center of the opening 18 may coincide, or the eccentric direction of the transparent region 21 may be the same as the eccentric direction of the opening 18.

In embodiments disclosed herein, the center of the opening 18 is eccentrically located from the center of the door frame 13 to an upper side (12 o'clock direction), and correspondingly, the center of the transparent region 21 is also eccentrically located from the center of the front glass 20 to the upper side (12 o'clock direction). The center of the transparent region 21 and the center of the opening 18 may alternatively coincide with each other.

The non-transparent region 22 may surround the transparent region 21. Also, the non-transparent region 22 does not transmit light therethrough, and thus, the glass itself may appear black in the non-transparent region 18.

The non-transparent region 22 may be a remaining portion except for the opening 18 of the door frame 13. A boundary line between the transparent region 21 and the non-transparent region 22 surrounding the transparent region 21 may be distinguished by the non-transparent region 22.

Alternatively, the boundary between the transparent region 21 and the non-transparent region 22 may be blurred through a halftone technique, thereby allowing a visual transition from the transparent region 21 to the non-transparent region 22. The non-transparent region 22 may include a plurality of shielding dots arranged around the transparent region 21, and the plurality of shielding dots may be arranged to have a lower density toward the transparent region 21.

The outer frame 14 may include a flat portion 15 and a curved portion 16. The flat portion 15 may be in contact with the rear surface of the front glass 20, and a portion of the flat portion 15 may overlap with the non-transparent region 22. An adhesive may be applied to the flat portion 15 so that the front glass 20 may be adhered to the flat portion 15.

An adhesive groove 37 may be formed concave in a ring shape in a front surface of the flat portion 15 facing the front glass 20, so that an adhesive may be filled therein. The rear surface of the front glass 20 may be adhered to the flat portion 15 by the adhesive.

The adhesive may overflow to outside or inside of the adhesive groove 37 when the adhesive is filled in the adhesive groove 37. In order to accommodate the adhesive overflowing from the adhesive groove 37, adhesive overflow grooves 38 may be formed in a ring shape at an inside and an outside of the adhesive groove 37, respectively.

The adhesive groove 37 and the adhesive overflow grooves 38 may be radially formed at an outer side of the flat portion 15. The non-transparent region 22 of the front glass 20 may cover the adhesive groove 37 and the adhesive overflow grooves 38.

A plurality of drain holes 39 may be formed through a lower side of the flat portion 15 in a thickness direction of the flat portion 15. Accordingly, water or moisture (liquid) generated between the rear surface of the front glass 20 and a front surface of the outer frame 14 may be discharged to outside through the plurality of drain holes 39.

The curved portion 16 may be curved in an arc shape having a predetermined curvature toward an outer circumference of the opening 18 formed in the inner frame 19 from an inner end of the flat portion 15. The curved portion 16 may overlap an outer edge portion or edge of the transparent region 21. The opening 18 may be located at an inner side of the curved portion 16 in a radial direction.

The mounting guide 34 may be formed on an outermost portion of the flat portion 15 in the circumferential direction to protrude more than the flat portion 15. An outer circumferential portion of the outer frame 14 may surround an outer edge of the front glass 20, thereby preventing the outer edge of the front glass 20 from being released radially outward from the flat portion 15 of the outer frame 14.

A chromium layer 17 may be disposed on front and outer circumferential surfaces of the outer frame 14 by chromium (or chrome) plating, for example. The outer frame 14 may be completely immersed in a chromium plating solution, followed by the chromium plating, so that the chromium layer 17 may be formed on an entire surface of the outer frame 14.

The chromium layer 17 may coat the outer frame 14 with a silver polished metal color. The chromium layer 17 may obtain an effect that it looks like bright silver circular droplets. In addition, the chromium layer 17 may give a luxurious look or feel when viewed with the naked eye.

The door window 23 may correspond to the laundry input port 106 when the door 12 is closed. The door window 23 may be mounted to the door frame 13 to correspond to the opening 18 of the inner frame 19.

The door window 23 may be made of a transparent material, for example, a synthetic resin material having a light transmitting property, so that an inner space of the laundry accommodating portion, such as the drum, may be viewed through the door window 23. The door window 23 may not be necessarily limited to such synthetic material but may alternatively be made of a glass material.

An outer edge portion or edge 231 of the door window 23 may be inserted and coupled between the outer frame 14 and the inner frame 19. The outer edge portion 231 of the door window 23 may have a flat shape, and may be fixedly disposed between a rear end of the curved portion 16 of the outer frame 14 and an inner end of the inner frame 19.

The door 12 may be rotatably provided with respect to the main body 10 by the hinge unit 24. The hinge unit 24 may include a hinge 25, a hinge holder 28, and a bush 29.

The hinge 25 may be fixed to the main body 10, and rotatably coupled to the door frame 13. The hinge 25 may include a plate-shaped base portion 26 coupled to the main body 10, and a rotation coupling portion 27 that protrudes from the base portion 26 and rotatably coupled to the door frame 13. A plurality of the rotation coupling portion 27 may be provided spaced apart from each other in an upward-downward direction.

The hinge holder 28 may be coupled to the door frame 13 to support the rotation coupling portions 27 to prevent the rotation coupling portions 27 from being released from the door frame 13. The bush 29 may be inserted into a rotational shaft of each rotation coupling portion 27 to smoothly rotate the rotational shaft.

The hinge unit 24 may be mounted at one or a first side of the door 12, and a locking unit 30 may be provided at another or a second side of the door 12. The locking unit 30 may be configured to lock or unlock the door 12 to or from the main body 10.

The locking unit 30 may include a shaft 31, a door latch 32, and a spring 33. The shaft 31 may pass through the door latch 32, and be mounted on the door frame 13. The spring 33 has an elastic force to be retractable during rotation of the door latch 32. The door latch 32 may be configured to be rotatable and restorable (or resilient) with respect to the door frame 13 so as to lock or unlock the door 12 with respect to the main body 10.

Figure 4:
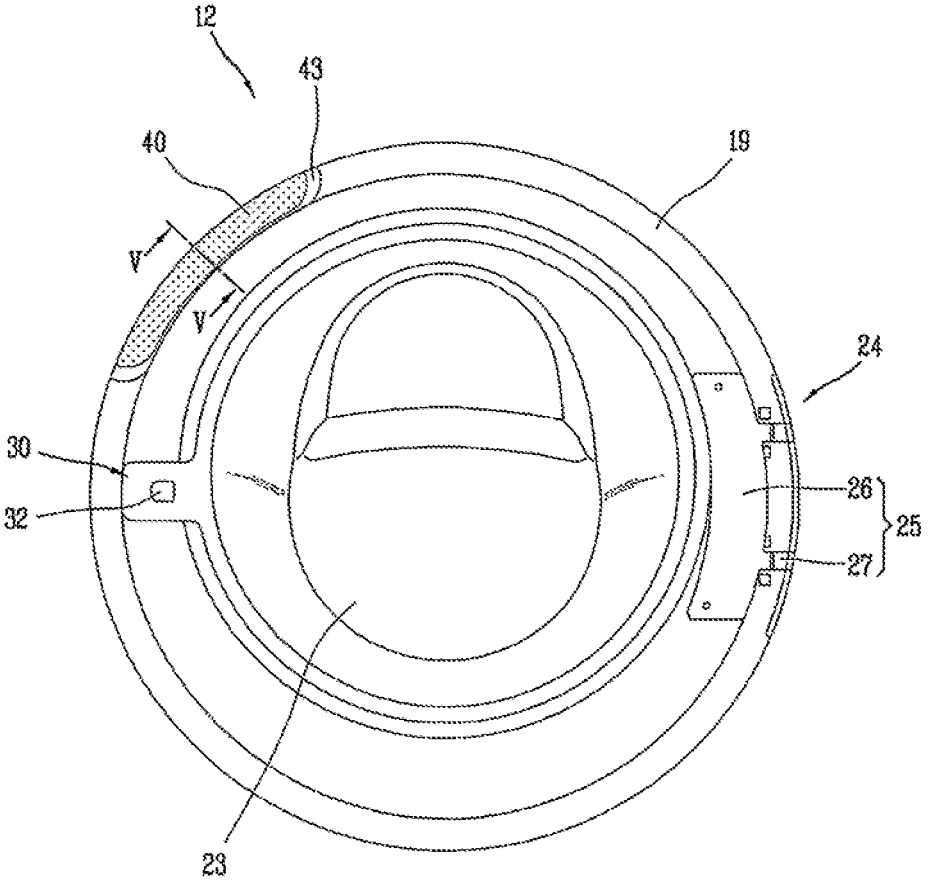
FIG. 4 is a rear view illustrating a state in which a handle is installed on a rear surface of the door in FIG. 1.
Figure 5:
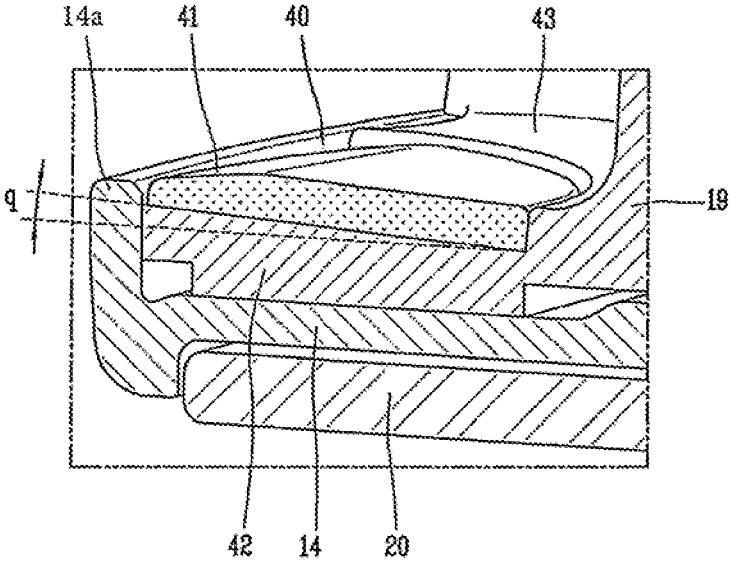
FIG. 5 is a cross-sectional view illustrating a state in which a handle is inclined backward on a door by adjusting a thickness of an inner frame, taken along line V-V in FIG. 4.

FIG. 4 is a rear view illustrating a state in which the handle 40 is installed on a rear surface of the door 12 in FIG. 1. FIG. 5 is a cross-sectional view, taken along the line V-V of FIG. 4, illustrating a state in which the handle 40 is inclined backward with respect to a rear of the door 12 by adjusting a thickness of the inner frame 19.

The handle 40 may be disposed at a rear surface of the door frame 13. The handle 40 may be disposed at one side of a rear surface of the inner frame 19. The handle 40 may be disposed in a direction opposite to the front glass 20.

The handle 40 may have an arcuate shape. A length of the handle 40 may be 1/36 to 1/4 of a total circumferential length of the door 12.

The handle 40 may be made of a rubber material, for example, to block heat transfer to the handle 40 from the outer frame 14 on which the chromium layer 17 is formed. This prevents the handle 40 from transferring cold. Accordingly, cold of the chromium layer 17, in which chromium is plated onto an outer surface of the outer frame 14, may not be transferred to the user.

The handle 40 made of the rubber material may give a soft feeling without giving any uncomfortable feeling to the user, and give a better grip. However, the handle 40 is not limited to the rubber material.

The rear surface of the inner frame 19 may be convex backward in a curved shape. A handle mounting portion 42 may be provided on or at one side of the rear surface of the inner frame 19 to be recessed forward, allowing the handle 40 to be mounted on the handle mounting portion 42. An adhesive surface may be formed inside of the handle mounting portion 42 as a flat surface, allowing the handle 40 to be attached to the handle mounting portion 42.

The handle mounting portion 42 may be disposed on or at an upper left side of the inner frame 19, when viewed from the rear of the door 12. The handle mounting portion 42 may be recessed in a shape corresponding to the handle 40, so as to surround an outer edge surface of the handle 40. The handle 40 may be attached to the handle mounting portion 42 with an adhesive, for example. A depressed portion 43 may be formed to be wider in both circumferential directions at both ends of the handle mounting portion 42, allowing the handle 40 to be easily installed.

The user may open the door 12 by pulling the handle 40. The handle 40 may be configured to prevent a hand from sliding outward on the rear surface of the door 12.

The handle 40 may be inclined backward with respect to a vertical plane of the front glass 20. This increases a sliding resistance of the handle 40, thereby preventing the hand from sliding radially outward on the rear surface of the door 12.

The handle 40 may be in the form of a plate having a constant thickness. The handle 40 may be provided with a side wall at opposite ends thereof, respectively, along the circumferential direction. Each of the plurality of side walls may be inclined or rounded. In this embodiment, the side walls are rounded.

The handle mounting portion 42, which is a portion of the inner frame 19, may be thinner in the frontward-to-backward direction of the door 12 compared to other parts of the inner frame 19. The handle mounting portion 42 may be inclined along the radial direction of the inner frame 19, so as to be thicker or increase in thickness from an inside toward an outside thereof in the radial direction. An inclination angle θ may be, for example, 3 degrees. Even if a thickness of the handle 40 is constant, the handle 40 may be inclined backward with respect to the vertical plane of the door 12 by an inclined surface of the handle mounting portion 42.

In order to prevent a hand from slipping on the handle 40, it is also possible to make the handle mounting portion 42 to have a constant thickness without making the handle 40 inclined. However, due to the nature of the rubber material, it is difficult to manage the rubber as it gets thicker. Therefore, it is possible to prevent handle slippage by making the handle 40 made of the rubber material to have a constant thickness, and the handle mounting portion 42 to which the handle 40 is attached inclined. The handle mounting portion 42 may be made of a synthetic resin material the same as the inner frame 19.

The outer frame 14 may further include a protruding portion 14*a* that protrudes from a rear surface of an outer circumferential portion to surround an outer edge of the handle mounting portion 42 and the handle 40, respectively, so that the handle mounting portion 42 and the handle 40 are closed (or covered) by the outer circumferential portion of the frame 14. The protruding portion 14*a* may protrude backward from the rear surface of the outer circumferential portion of the outer frame 14, so that the outer circumferential portion of the handle 40 may be prevented from being radially separated outward from the handle mounting portion 42.

A tapered portion 41 may be formed to be radially tapered at an outer end portion of the rear surface of the handle 40 (the surface that comes in contact with a hand). The tapered portion 41 may be thinner or decrease in thickness from an inside toward an outside of the inner frame 19 in the radial direction, and an outer end of the tapered portion 41 may correspond to a rear end portion of the protruding portion 14*a*.

With this structure, a step between the protruding portion 14*a* of the outer frame 14 and the outer end of the tapered portion 41 of the handle 40 may be eliminated, which allows the user to put fingers into the rear surface of the handle 40 easier for pulling the handle 40. Further, a simpler appearance of the outer frame 10 and the handle 40 of the inner frame 19 may be achieved.

Figure 6:
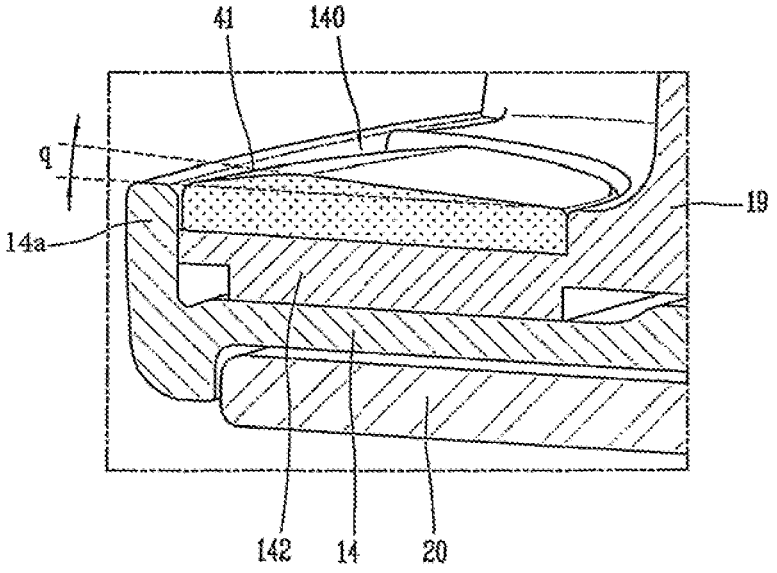
FIG. 6 is a cross-sectional view illustrating a state in which a handle is inclined backward on a door by adjusting a thickness of the handle in accordance with another embodiment.

FIG. 6 is a cross-sectional view illustrating a state in which the handle 140 is inclined on the rear of the door 12 by adjusting a thickness of the handle 140 according to another embodiment. This embodiment differs from the previous embodiment of FIG. 5 in that the rear surface of the handle 140 is inclined by adjusting the thickness of the handle 140.

In the embodiment of FIG. 5, the handle 140 is inclined on the rear of the door 12 by adjusting the thickness of the inner frame 19 (the handle mounting portion 142). In this embodiment, the handle mounting portion 142 may have a constant (or uniform) thickness, and the handle 140 may be inclined on the rear of the door 12, thereby preventing a hand from sliding off the handle 140.

The other components are the same as/like those of the foregoing embodiment of FIG. 5. Thus, detailed description thereof has been omitted.

Figure 7:
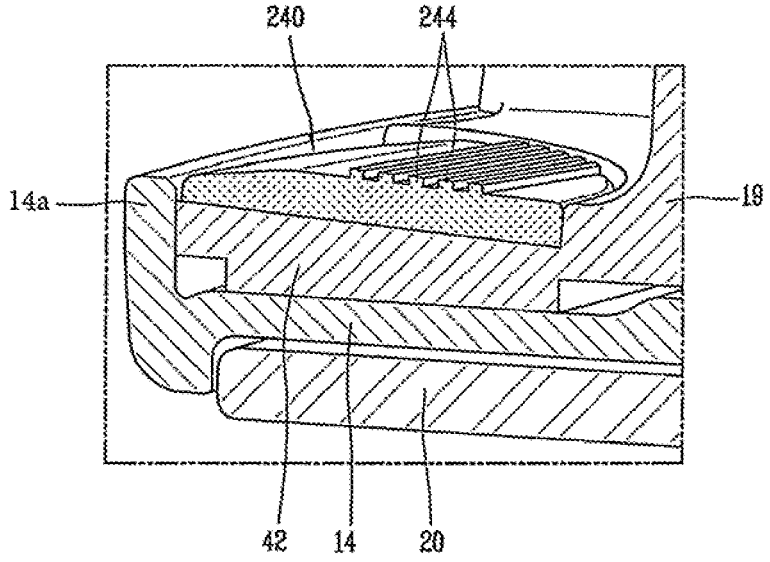
FIG. 7 is a cross-sectional view illustrating a state in which a protrusion is provided to prevent hands from slipping on a handle in accordance with another embodiment.

FIG. 7 is a cross-sectional view illustrating a state in which a protrusion 244 is provided to prevent a hand from slipping on a handle 240 according to another embodiment. This embodiment differs from the previous embodiment of FIG. 5 in that a plurality of protrusions 244 is formed on the handle 240. In this embodiment, the protrusion 244 is formed in a stripe pattern having a narrow width and a long length, but the shape is not limited to this. It may have an embossed shape in various patterns, such as a square, or a circle, for example.

The plurality of protrusions 244 may prevent the hand from sliding off the handle 240. The other components are the same as/like as those of the previous embodiment of FIG. 5, and thus, detailed description thereof has been omitted.

Figure 8:
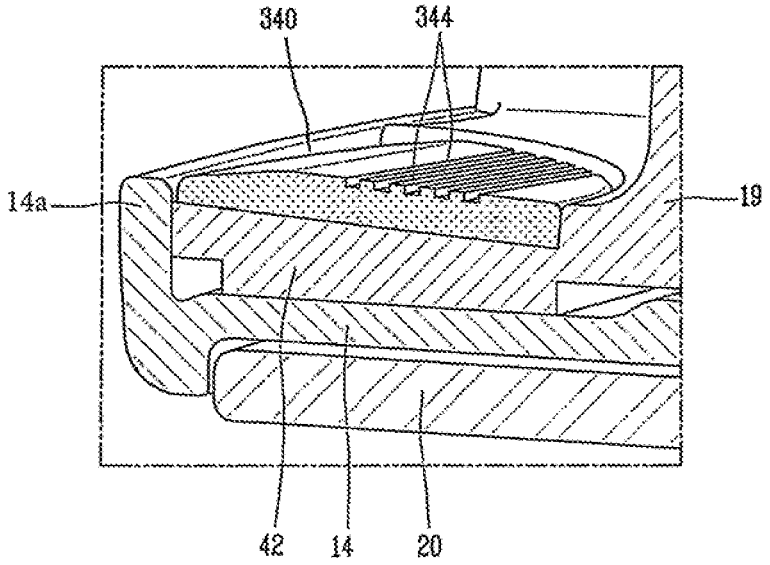
FIG. 8 is a cross-sectional view illustrating a state in which a groove is provided to prevent hands from slipping on a handle in accordance with another embodiment.

FIG. 8 is a cross-sectional view illustrating a state in which a groove 344 is provided to prevent a hand from sliding off a handle 340 according to another embodiment. This embodiment differs from the previous embodiment of FIG. 5 in that a plurality of grooves 344 is formed in the handle 340.

In this embodiment, a shape of the groove 344 is formed as a stripe pattern having a narrow width and a long length, but the shape is not limited to this. It may have an intaglio shape in various patterns, such as a rectangle, or a circle, for example. The other components are the same as/like those of the previous embodiment of FIG. 5, and thus, detailed description thereof has been omitted.

Figure 9:
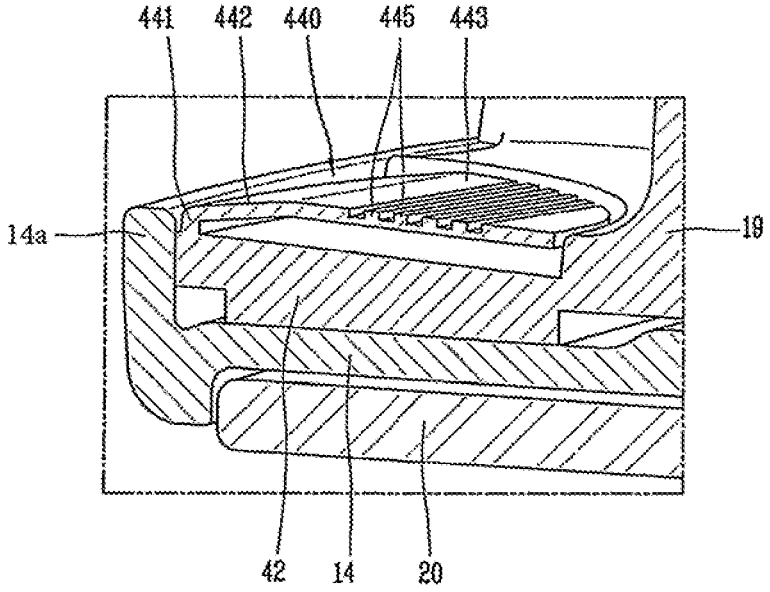
FIG. 9 is a cross-sectional view illustrating a state in which an elastic structure is provided to prevent hands from slipping on a handle in accordance with another embodiment.

FIG. 9 is a cross-sectional view illustrating a state in which an elastic structure is provided to prevent a hand from sliding off a handle according to another embodiment. This embodiment differs from the previous embodiments in that the handle 440 is integrally formed with the inner frame 19.

In this embodiment, the handle 440 may be disposed such that one or a first side thereof is connected to the handle mounting portion 42 and the other or a second side is spaced rearward from the handle mounting portion 42. The handle 440 may include a first portion 441 that protrudes backward from an outer end portion or end in the radial direction of the handle mounting portion 42, a second portion 442 tapered from the first portion 441, and an elastic pressing portion 443 radially extending inward from the second portion 442.

The first portion 441 and the second portion 442 may be connected to the handle mounting portion 42 to support the elastic pressing portion 443. The second portion 442 may connect the first portion 441 and one side of the elastic pressing portion 443, and be inclined in a direction spaced apart from the handle mounting portion 42.

The elastic pressing portion 443 may be elastically bent toward the front glass 20 in a direction to the handle mounting portion 42, when pressed by the hand. When the elastic pressing portion 443 is pressed, it is bent toward the handle mounting portion 42, thereby preventing the hand from slipping off the handle 440. When a force applied to the elastic pressing portion 443 is released, the elastic pressing portion 443 may be returned to its original position. A plurality of grooves 445 may be formed in the elastic pressing portion 443, thereby maximizing the effect of preventing the hand from slipping on the handle 440.

Figure 10:
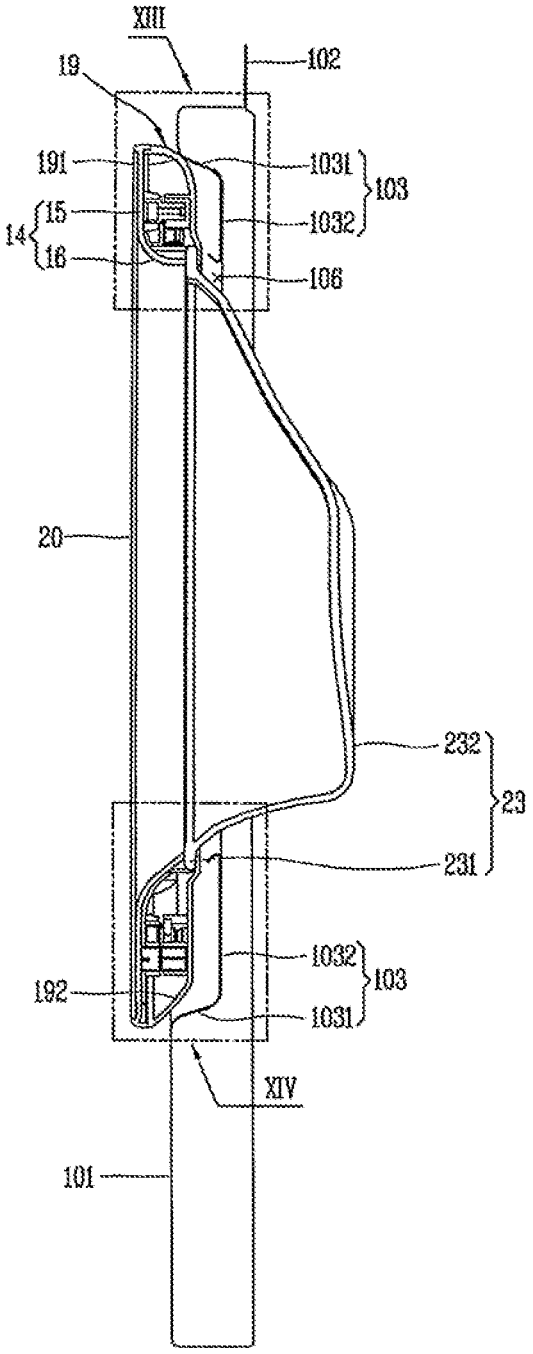
FIG. 10 is a cross-sectional view illustrating a state in which a door is mounted to a front panel of a main body to close a laundry inlet port, taken along line X-X in FIG. 1.
Figure 11:
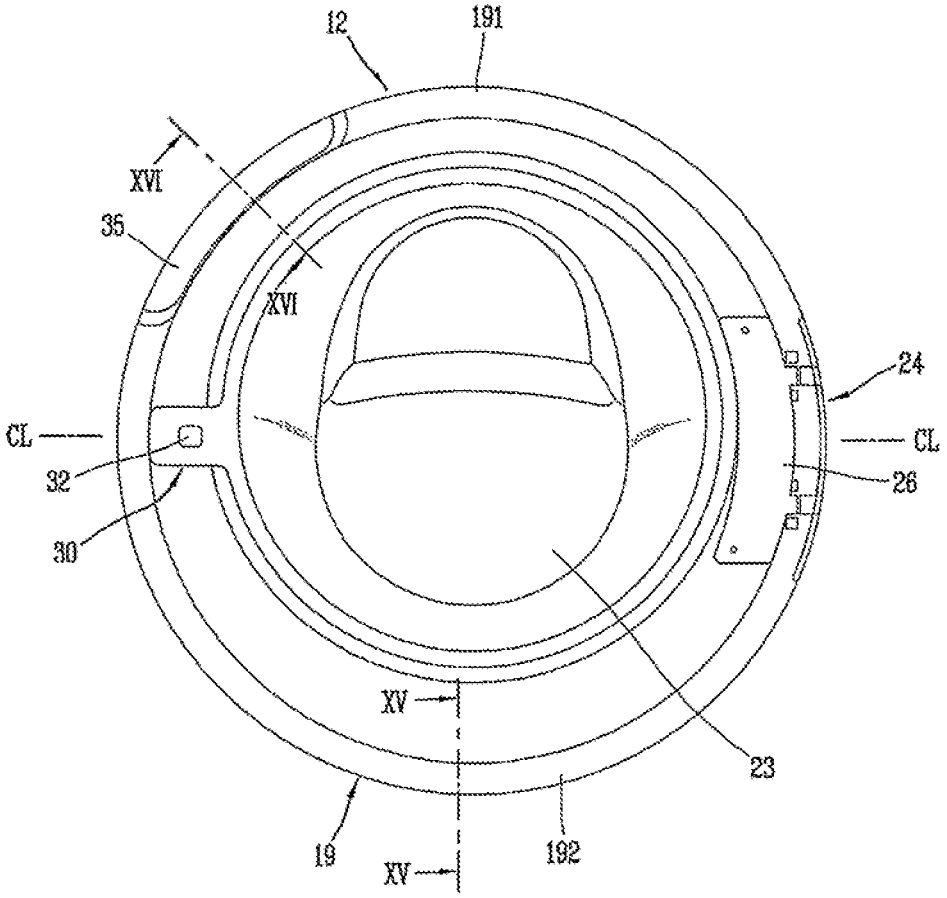
FIG. 11 is a rear view of the door of FIG. 2.
Figure 12:
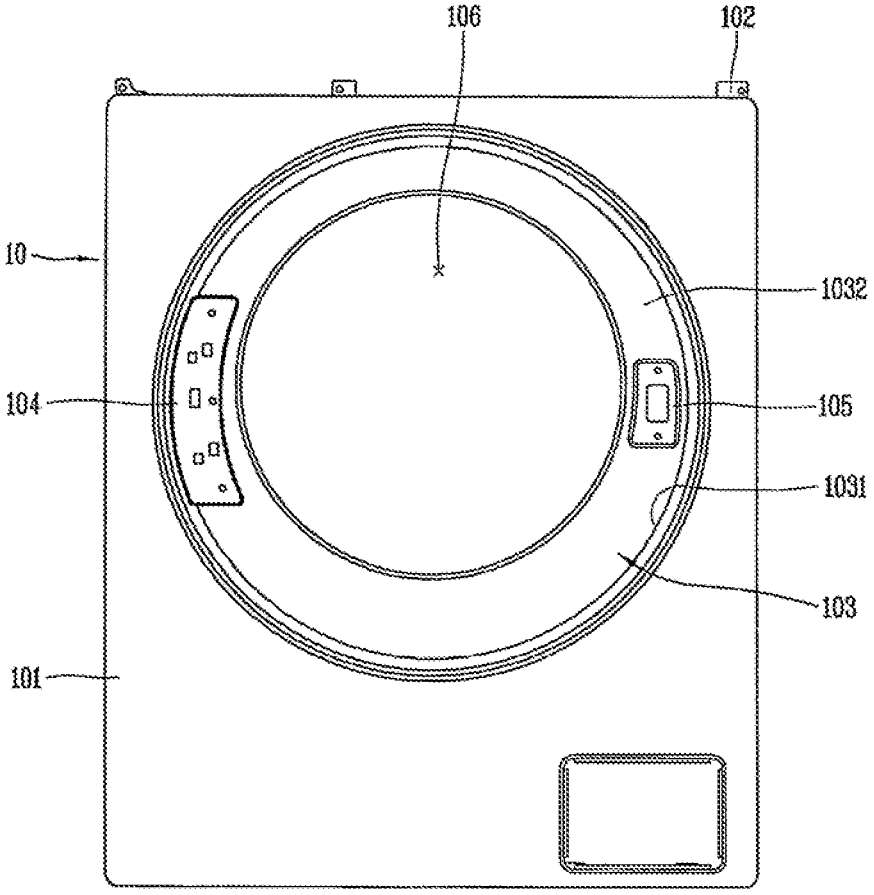
FIG. 12 is a front view illustrating a state in which a recess is recessed into a front panel to surround a laundry inlet port in FIG. 10.
Figure 13:
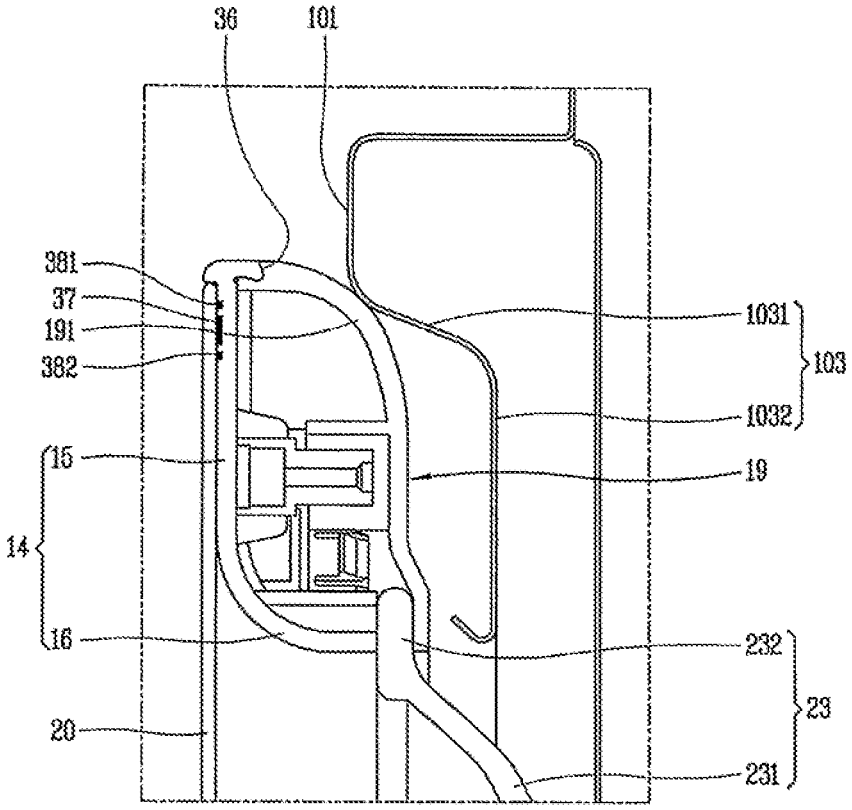
FIG. 13 is an enlarged cross-sectional view illustrating a portion "XIII" in FIG. 10, in which a contact portion is in contact with a recess of a main body.

FIG. 10 is a cross-sectional view, taken along the line X-X in FIG. 1, illustrating the door 12 mounted on the front panel 101 of the main body 10 to close the laundry inlet port 106. FIG. 11 is a rear view of the door in FIG. 2. FIG. 12 is a front view illustrating that the recess 103 is recessed in the front panel 101 to surround the laundry inlet port 106 in FIG. 10. FIG. 13 is an enlarged cross-sectional view of portion "XIII" in FIG. 10, illustrating that a contact portion 191 is in contact with the recess 103 of the main body. FIG. 14 is an enlarged cross-sectional view of portion "XIV" in FIG. 10, illustrating that a non-contact portion 192 is spaced apart from the recess 103 of the main body 10.

FIG. 10 illustrates a state in which the controller 11 of FIG. 1 is removed from an upper side of the front panel 101. A plurality of ribs 102 may protrude upward from an upper end portion or end of the front panel 101. The controller 11 may be mounted on the upper end portion of the front panel 101. A rear surface of the controller 11 and the plurality of ribs 102 may be coupled by coupling elements, such as screws.

Referring to FIG. 11, a handle 35 may be formed in a manner of recessing a rear upper side of the inner frame 19, so that the user may open the door 12 by pulling the handle 35. The rear surface of the inner frame 19 may be convex rearward in an arcuate shape.

The handle 35 may be provided on the door 12 for the user to open and close the door 12. In the related art, the handle is generally provided on a front side of the door. However, in embodiments disclosed herein, as the front glass 20 is provided to cover the front surface of the door 12, it is difficult to provide the handle 35 on the front glass 20. Thus, the handle 35 is not provided on the front surface of the door 12 due to the front glass 20, but rather, may be provided on the rear surface of the door 12. The handle 35 may be provided on the inner frame 19.

In addition, the handle 35 may be provided at an upper portion of the door 12 for the user to easily pull the door 12. This is because, when the handle 35 is provided at a lower portion of the door 12, the user has to bend his or her waist and knees more to pull the handle 35.

Moreover, as the hinge unit 24 and the locking unit 30 are respectively provided at lateral sides of the door frame 13, respectively, along a horizontal center line CL-CL that horizontally passes through the center of the door frame 13 in a radial direction, they are positioned higher than the horizontal center line. In addition, the handle 35 is disposed on the upper side of the door frame 13 to be higher than the locking unit 30 in order to open and close the door 12 with less force.

The handle 35 may be disposed on the upper side of the rear surface of the inner frame 19. More specifically, when the door 12 is closed, the handle 35 may be located at a right upper portion, namely, between one o'clock and three o'clock, when viewed from the front of the main body 10.

The handle 35 may be recessed into the convex rear surface of the inner frame 19 toward the outer frame 14. The handle 35 may be formed in an arcuate shape on the rear surface of the inner frame 19 along a partial section of the rear surface in a circumferential direction.

The handle 35 may be thin and flat compared to an outer circumference of the inner frame 19 (a portion of the inner frame except the handle 35). When the door 12 is closed by the user, the handle 35 is recessed forward in the flat shape, compared with the outer circumference on the rear surface of the inner frame 19, when viewed from the front of the main body 10, thereby facilitating insertion of the user's hand into the handle 35 as well as facilitating identification of a position of the handle 35 in the closed state of the door 12.

Referring to FIGS. 10 and 11, the recess 103 may be provided on the front panel 101 of the main body 10. The recess 103 may accommodate a portion of the door 12, more particularly, a portion of the door frame 13, more particularly, a portion of the inner frame 19. The recess 103 may include a recessed portion 1031, and a flat portion 1032.

The recessed portion 1031 may be recessed rearward into the front surface of the front panel 101 toward the inside of the main body 10. The recessed portion 1031 may have a larger diameter than the laundry inlet port 106 and may be formed in a curved shape along the circumferential direction.

The recessed portion 1031 may be formed in a circular shape to surround an outer circumference of the flat portion 1032. The recessed portion 1031 may have sides connected to the front surface of the front panel 101 and the flat portion 1032, so that the flat portion 1032 is stepped toward the inside of the main body 10 with respect to the front surface of the front panel 101. The recessed portion 1031 may be bent backward from the front surface of the front panel 101.

The recessed portion 1031 may be inclined while its diameter gradually decreases from a front end to a rear end thereof. The flat portion 1032 may be disposed toward the inside of the main body 10 more rearward than the front surface of the front panel 101.

The flat portion 1032 may extend perpendicularly in the form of a flat plate, and the laundry inlet port 106 may penetrate through the inside of the flat portion 1032 in a thickness direction. The flat portion 1032 may be defined in a ring shape.

The laundry inlet port 106 may be formed eccentrically from a center of the recess 103. For example, a center of the laundry inlet port 106 may be located higher than the center of the recess 103. As a result, a width (a radial distance) of the flat portion 1032 becomes wider (longer) from an upper portion to a lower portion of the flat portion 1032.

A hinge portion 104 to couple with the hinge unit 24 may be provided at a left or first side of the flat portion 1032, so that the hinge unit 24 may be hinged to the hinge portion 104. A locking portion 105 to couple with the locking unit 30 may be provided at a right or a second side of the flat portion 1032, so that the locking unit 30 may be coupled to the locking portion 105.

The door 12 may be fixed to lateral sides of the flat portion 1032 by the hinge unit 24 and the locking unit 30 when the laundry inlet port 106 is closed. The hinge portion 104 and the locking portion 105 may be disposed on the horizontal center line CL-CL horizontally passing the center of the flat portion 1032 in the radial direction, when looking at the circular flat portion 1032 from the front of the main body 10.

A curling portion may be formed on an inner end of the flat portion 1032. The curling portion may have a form in which an end of the flat portion 1032 is curled into a rounded shape, thereby removing a sharp portion of the inner end of the flat portion 1032. Damage to laundry due to friction with the inner end of the flat portion 1032 may be prevented when the laundry is loaded or unloaded through the laundry inlet port 106 located at the inner end of the flat portion 1032, and injury to a hand, for example, which may be caused due to a contact with the inner end of the flat portion 1032 may be avoided.

Referring to FIGS. 10 and 11, the door window 23 may include outer edge portion 231 formed in a circular shape on a front end thereof, and a protruding portion 232 that protrudes toward the inside of the drum from the outer edge portion 231. The protruding portion 232 may have a curved shape. The protruding portion 232 may have an upper surface, side surfaces, a lower surface, and a rear surface. Both the side surfaces and the rear surface of the protruding portion 232 may be configured to connect the upper and lower surfaces of the protruding portion 232.

The upper and lower surfaces of the protruding portion 232 may be formed asymmetrically. For example, the upper surface of the protruding portion 232 may be inclined smoothly relative to the lower surface of the protruding portion 232, and the lower surface of the protruding portion 232 may be inclined sharply relative to the upper surface of the protruding portion 232. The rear surface of the protruding portion 232 may be formed almost in a perpendicularly flat surface. With this configuration, the door window 23 may cover the opening 18 of the inner frame 19, and the protruding portion 232 may protrude into the drum through the laundry inlet port 106 when the door 12 is closed.

When a large quantity of laundry is loaded into the drum, the laundry may collide with the door window 23 protruding into the drum while rotating along the inner circumferential surface of the drum. Embodiments disclosed herein prevent the door 12 from being lifted towards the outside of the main body 10 due to the collision between the laundry and the door window 23.

A contact portion (pivot portion) 191 may be provided on the rear surface of the door frame 13. The contact portion 191 may be brought into contact with the main body 10 when the door 12 is closed. The contact portion 191 may be formed integrally with the rear surface of the inner frame 19. The contact portion (pivot portion) 191 may function as a pivot about which the door may pivot upon application of an internal force to the door.

The contact portion 191 may be in contact with a front end of the front panel 101, a front end of the recess 103, or a boundary portion between the front panel 101 and the recess 103. The boundary portion between the front panel 101 and the recess 103 is a portion where the recess 103 starts to be recessed.

The recessed portion 1031 may be understood as including the portion where the recess 103 starts to be recessed. The contact portion 191 may be brought into contact with the recessed portion 1031 of the recess 103. When the contact portion 191 is in contact with the recessed portion 1031 of the recess 103, a contact area between the contact portion 191 and the main body 10 may be minimized. Further, when the contact portion 191 is in contact with the recessed portion 1031 of the recess 103, the contact portion 191 may be smoothly connected in a curved shape to the rear surface of the inner frame 19 without protruding.

In embodiments disclosed herein, the rear surface of the inner frame 19 may have an arcuate cross section and may be convex toward the front surface of the front panel 101 and the flat portion 1032. The rear surface of the inner frame 19 may have an arcuate cross section.

The rear surface of the inner frame 19 may be asymmetric at upper and lower portions. The inner frame 19 may be formed such that an upper portion of the rear surface has a greater curvature than the lower portion of the rear surface.

The rear surface of the inner frame 19 may face the front panel 101 or the flat portion 1032. The upper portion of the rear surface of the inner frame 19 denotes a portion of the rear surface located above the horizontal center line CL-CL horizontally passing through the center of the inner frame 19 in the radial direction, when looking at the rear surface of the inner frame 19 from the rear side.

The lower portion of the rear surface of the inner frame 19 denotes a portion of the rear surface located below the horizontal center line CL-CL. The contact portion 191 may be located on the upper portion of the rear surface of the inner frame 19, so as to allow the upper portion of the rear surface of the inner frame 19 to be in contact with the recessed portion 1031 of the main body 10.

The contact portion 191 may curved on the upper portion of the rear surface of the inner frame 19. The contact portion 191 may have a curved shape having a greater curvature than that of the lower portion of the rear surface of the inner frame 19.

The contact portion 191 may have an arcuate shape from the rear surface of the inner frame 19 toward the recessed portion 1031. The contact portion 191 may circumferentially extend from the upper portion of the rear surface of the inner frame 19 so as to have an arcuate cross section. In this case, the contact portion 191 may have a circumferential length which is ½ of or shorter than an entire circumference of the inner frame 19 along the circumferential direction of the inner frame 19. For example, when an outer diameter of the inner frame 19 is D (mm), the contact portion 191 may be $\pi D/2$ or shorter.

The contact portion 191 may be formed at one side of the rear surface of the inner frame 19 or a plurality of contact portions 191 may be formed spaced apart from the upper portion of the rear surface of the inner frame 19 in the circumferential direction. In embodiments disclosed herein, the single contact portion 191 having the arcuate cross section extends from the upper portion of the rear surface of the inner frame 19 along the circumferential direction.

Referring to FIG. 13, the recessed portion 1031 may be inclined downward toward the flat portion 1032 with respect to the perpendicularly-formed front surface of the front panel 101. An outer side of the front end of the recessed portion 1031 connected to the front surface of the front panel 101 may be rounded. The outer side of the front end of the recessed portion 1031 may be formed to have a radius of curvature which is significantly smaller than a radius of curvature of the contact portion 191.

A radius of an arc formed by the contact portion 191 may be much larger than a radius of an arc formed by the outer side of the front end of the recessed portion 1031. The arc of the contact portion 191 and the arc formed by the outer side of the front end of the recessed portion 1031 may be disposed to be adjacent to each other.

The contact portion 191 may be in contact with the outer side of the front end of the recessed portion 1031 when the door 12 is closed, and the contact between the contact portion 191 and the outer side of the front end of the recessed portion 1031 may be made on a curved surface of the arcs externally brought into contact with each other. With this configuration, the contact portion 191 formed on the rear surface of the door frame 13 may be in contact with one side of the main body 10, namely, the outer side (rounded portion) of the front end of the recessed portion 1031 formed at the front panel 101, when the door 12 is closed. In this case, the contact portion 191 may be in point contact or line contact with the one side of the main body 10.

A first portion of the door frame 13 may protrude forward from the outer side of the recess 103 based on the contact portion 191. A second portion of the door frame 13 may be accommodated in the recess 103.

A non-contact portion 192 may be provided on the lower portion of the rear surface of the inner frame 19. The non-contact portion 192 may be formed with a curvature smaller than that of the contact portion 191. The non-contact portion 192 may be inclined smoothly relative to the contact portion 191. Thus, the non-contact portion 192 may be spaced forward apart from the lower side of the recessed portion 1031 of the recess 103.

Therefore, according to embodiments disclosed herein, the contact portion 191 may be provided at the upper portion on the rear surface of the door frame 131, and may be brought into contact with the recessed portion 1031 of the recess 103 of the main body 10 when the door 12 is closed, so that lifting of the door 12 may be prevented even if laundry spinning along the inner circumferential surface of the drum collides with the door window 23 when the laundry is loaded in a large quantity.

More specifically, when a large quantity of laundry is accommodated in the drum, the laundry may be moved down to a bottom of the drum due to gravity and centrifugal force in a state of being wet with water, and hit the lower portion of the door window 23 during spinning. When an impact is applied to the door window 23 due to the spinning of the laundry, the lower portion of the rear surface of the door frame 13 is pressed from the inside of the drum.

In a state in which the hinge unit 24 and the locking unit 30 respectively disposed at the lateral sides on the rear surface of the door frame 13 are fixed to the flat portion 1032, the contact portion 191 provided at the upper portion on the rear surface of the door frame 13 may be brought into contact with the recessed portion 1031 formed in the front panel 101 of the main body 10, so as to resist lifting of the door 12, thereby preventing vibration or shaking of the door 12 even if an impact is applied to the lower portion of the door frame 13. In addition, the contact portion 191 extends in an arcuate curved shape along the circumferential direction of the door frame 13. The contact portion 191 may not protrude from one side of the rear surface of the door frame 13, but rather, may form a curved surface smoothly connected to its adjacent portions without a bent portion, thereby allowing the door to have a beautiful appearance.

In particular, the rear surface of the door 12 may be brought into contact with the recessed portion 1031 where the recess 103 starts to be recessed, by the contact portion 191. The contact portion 191 may cover the inside of the recess 103. Therefore, the door window 23 protruding from the rear surface of the door to the inner space of the main body 10 may be covered, thereby improving an appearance of the door 12.

In addition, the contact portion 191 of the door 12 may not protrude from the rear surface of the door 12, but rather, may be brought into contact with the recessed portion 1031 where the recess 103 starts to be recessed, without being in contact with the flat portion 1032 of the recess 103, thereby preventing an increase in unnecessary material costs due to an increase in size of the contact portion 191.

Also, the contact portion 191 may be curved toward the front panel 101 or the recess 103 to have a cross section in an arcuate shape, so as to be in point contact or line contact with the recessed portion 1031, thereby minimizing a contact area of the contact portion 191 when the door 12 is closed. Accordingly, an impact applied to the main body 10 may be dispersed along the circumferential direction of the recess 103 when the main body 10 is brought into contact with the contact portion 191 due to rotation of the door 123, resulting in minimizing the impact applied to the main body 10.

A contact state between the contact portion 191 and the main body 10 may be maintained after the door 12 is closed, and thus, vibration and noise occurring between the door 12 and the main body 10 may be minimized even though an impact is repetitively applied from the laundry accommodated in the drum through the door window 23. In addition, even if the lower portion of the door frame 13 is lifted inside of the drum due to the impact applied to the door window 23, lateral sides of the door 12 and an upper end of the door 12 may be supported at a plurality of points on the front panel 101. For example, the plurality of points may include at least three support points, each a vertex of a triangle. Both left and right or lateral support points of the three support points may be formed as the hinge unit 24 and the locking unit 30 of the door 12 are coupled to the main body 10. The upper support point of the three support points may be formed by the contact between the contact portion 191 and the main body 10. Thus, a suppression force against vibration or shaking of the door 12 may be improved significantly.

In addition, as the arcuate curved surface of the contact portion 191 and the arcuate curved surface of the recessed portion 1031 where the door 12 and the main body 10 are in contact with each other may realize a point contact or a line contact with each other, thereby minimizing friction between the mutual contact surfaces. Moreover, even if the lifting of the door 12 occurs, the contact point between the door frame 13 and the recess 103 moves on the arcuate curved surface, so as to prevent the contact portion 191 of the door frame 13 from being spaced apart from the main body 10, thereby achieving stable contact.

In addition, an impact transferred from the inside of the drum through the door window 23 may be alleviated by virtue of stable contact between the contact portion 191 of the door frame 13 and the recess 103 of the main body 10. Accordingly, neither a separate buffer member between the door 12 and the main body 10 nor an installation space of the buffer member are needed, thereby accommodating more of the door 12 in the recess 103, resulting in implementing a compact arrangement of the door 12.

Figure 15:
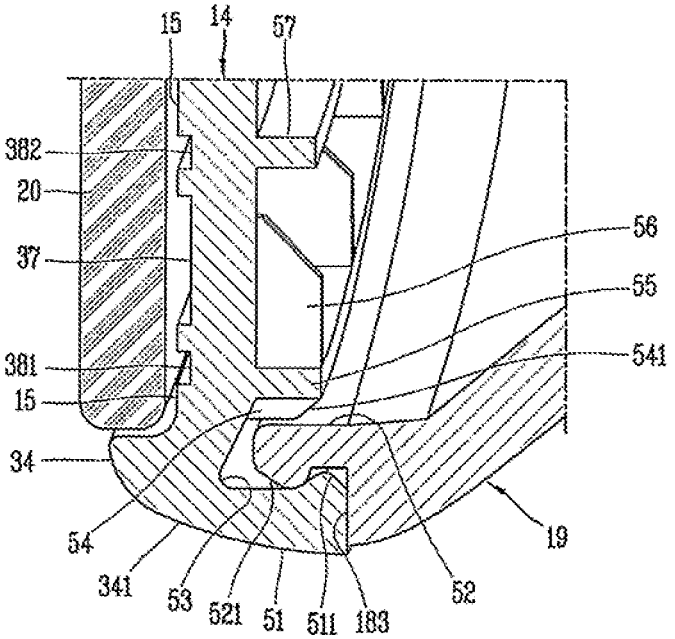
FIG. 15 is a schematic view illustrating a hook coupling structure between an outer frame and an inner frame, taken along line XV-XV in FIG. 11.
Figure 16:
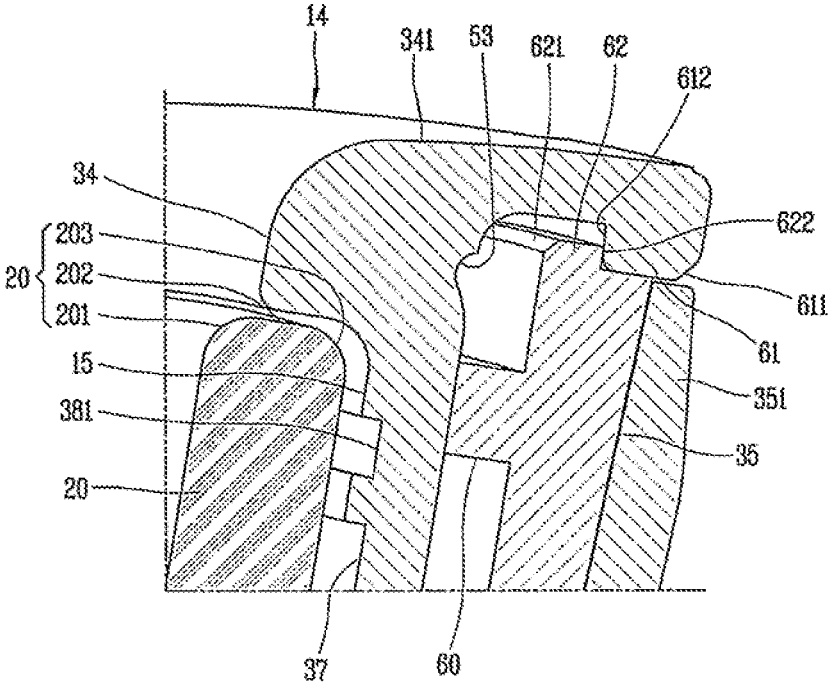
FIG. 16 is a schematic view illustrating a hook coupling structure between the outer frame and a handle, taken along line XVI-XVI in FIG. 11.
Figure 17:
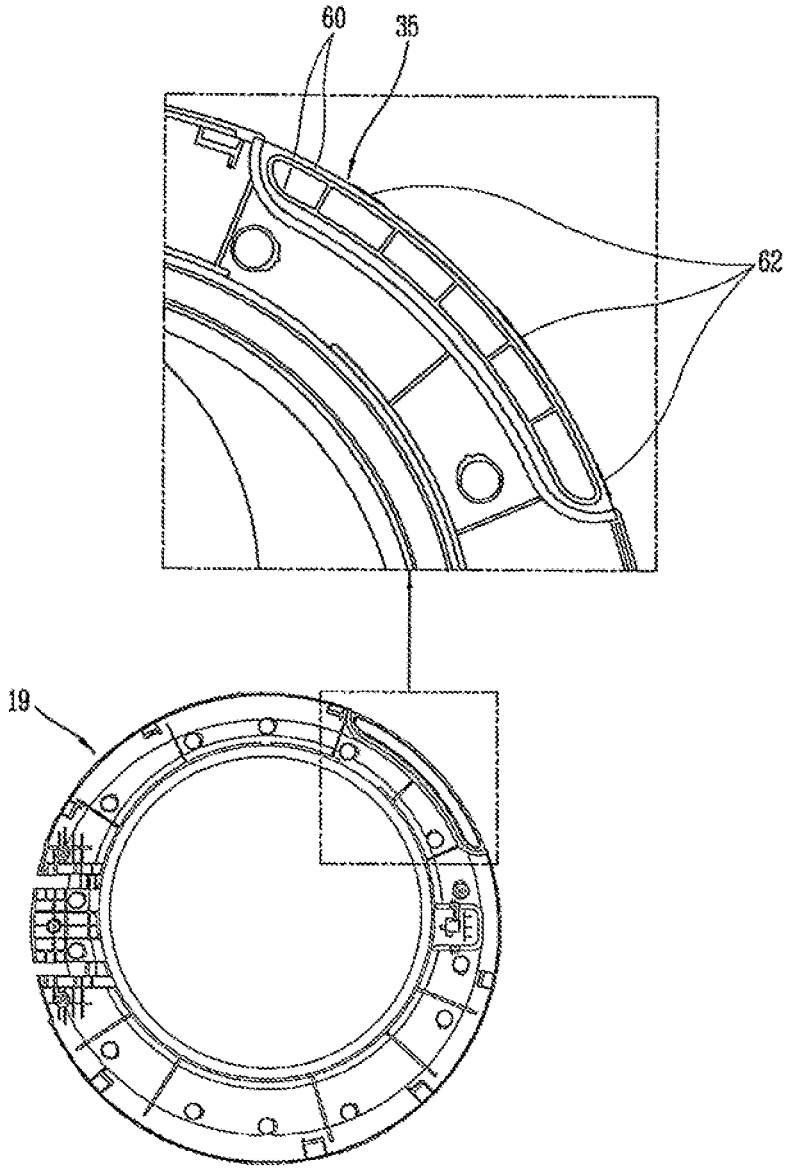
FIG. 17 is a schematic view illustrating a state in which a hook is partially disposed on the handle, when the inner frame of FIG. 11 is viewed from the front.

FIG. 15 is a schematic illustrating a hook coupling structure between an outer frame and an inner frame, taken along line XV-XV in FIG. 11. FIG. 16 is a schematic view illustrating a hook coupling structure between the outer frame 14 and the handle 35, taken along line XVI-XVI in FIG. 11. FIG. 17 is a schematic view illustrating a state in which a hook is partially disposed on the handle 35, when the inner frame of FIG. 11 is viewed from the front.

In order to couple the outer frame 14 and the inner frame 19 to each other, hooks 51, 52 may be provided on the outer frame 14 and the inner frame 19, respectively. The hooks 51, 52 may include first hook 51 provided on the outer frame 14 and second hook 52 provided on the inner frame 19. Each of the first hook 51 and the second hook 52 may have a ring shape along the circumferential direction. The first and second hooks 51, 52 may be coupled to each other by an interference or snap fit to couple the outer frame 14 and the inner frame 19, as discussed herein below.

The first hook 51 may protrude from the outer frame 14 toward the inner frame 19. The first hook 51 may be disposed outside of the radial direction of the mounting guide 34 to surround an outer circumferential portion of the inner frame 19. The first hook 51 may be disposed outside of the mounting guide 34 when viewed from the front of the main body 10.

The mounting guide 34 and the first hook 51 may be integrally connected by extension portion 341. The extension portion 341 may extend from the mounting guide 34 to the first hook 51. The extension portion 341 may extend from the mounting guide 34 to the first hook 51 to gradually increase in diameter. The extension portion 341 may have a curved shape.

Each of the mounting guide 34, the first hook 51, and the extension portion 341 may extend along the circumferential direction of the outer frame 14. According to this embodiment, the mounting guide 34, the extension portion 341, and the first hook 51 may define an outer circumferential surface of the outer frame 14 in one curved shape to cover the inner frame 19, so as to cover up the main body 10 when viewed the front of the main body 10, thereby enhancing and beautifying an appearance of the door 12. Each of the mounting guide 34, the extension portion 341, and the first hook 51 may have a curved or inclined surface shape without wrinkles or steps, so that a diameter thereof gradually increases from the mounting guide 34 to the first hook 51.

The first hook 51 and the second hook 52 may be disposed to radially overlap with each other. The first hook 51 may have a larger diameter than the second hook 52, and the second hook 52 may be inserted into the first hook 51.

A mounting groove 183 may be disposed between an outer circumferential end of the inner frame 19 and the second hook 52 along the circumferential direction. The second hook 52 may be disposed in a stepped manner radially inward from the outer circumferential end of the inner frame 19. A radial height of the mounting groove 193 may be the same or similar to a thickness of the first hook 51.

After the outer frame 14 and the inner frame 19 are coupled to each other, a step may be eliminated between an outer circumferential end of the first hook 51 and the outer circumferential end of the inner frame 19, thereby beautifying the appearance of the door 12. The first hook 51 may protrude backward from an outer circumferential portion of the outer frame 14 toward the inner frame 19. A hook protrusion 511 may protrude radially inward toward the second hook 52 from an inner circumferential surface of the first hook 51.

The second hook 52 may protrude forward from an outer circumferential portion of the inner frame 19 toward the outer frame 14. A hook protrusion 521 may protrude radially outward from an outer circumferential surface of the second hook 52 toward the first hook 51. The hook protrusion 511 of the first hook 51 and the hook protrusion 521 of the second hook 52 may protrude parallel to each other in the radial direction.

The hook protrusion 511 and the hook protrusion and 512 may be defined in a wedge shape at respective end portions of the first hook 51 and the second hook 52. The hook protrusion 511 of the first hook 51 and the hook protrusion 521 of the second hook 52 may overlap with each other in the axial direction. The hook protrusions 511 and 512 allow the first hook 51 and the second hook 52 to be easily engaged with each other, but may not allow the first hook 51 and the second hook 52 from being released from each other in opposite directions.

Each of the hook protrusion 511 of the first hook 51 and the hook protrusion 521 of the second hook 52 may be configured as a first inclined surface in contact with each other prior to fastening and a second inclined surface disposed to be inclined on an opposite side of the first inclined surface to be in contact with each other subsequent to fastening. The first inclined surface and the second inclined surface of each hook protrusion 511, 521 may be inclined in opposite directions with respect to a vertex of each hook protrusion 511, 521.

Slopes of the first inclined surface and the second inclined surface may be different from each other. The first inclined surface of each hook protrusion 511, 521 facing each other prior to fastening may be less inclined than the second inclined surface of each hook protrusion 511, 521 facing each other subsequent to fastening. In other words, the second inclined surface of each hook protrusion 511, 521 facing each other subsequent to fastening may be more sharply inclined than the first inclined surface of the hook protrusion 511 and 521 facing each other prior to fastening.

The first hook 51 and the second hook 52 may move toward each other in the axial direction so that the hook protrusion 511 and the hook protrusion 521 are engaged with each other, allowing the outer frame 14 and the inner frame 19 to be coupled to each other. Moreover, the hook protrusions 511 and 521 may facilitate engagement between the first hook 51 and the second hook 52 toward each other but prevent them from being released from each other in opposite directions as long as there is no damage to the first hook 51 or the second hook 52. That is, when the first hook 51 and the second hook 52 move toward each other in the axial direction to fasten the outer frame 14 and the inner frame 19, a movement resistance between the hook protrusion 511 and the hook protrusion 521 prior to fastening may be reduced, and the hook protrusions 511 and 521 may be restricted from moving in a direction of being released from each other while the second inclined surfaces are brought into contact with each other subsequent to fastening the first hook 51 and the second hook 52.

The outer frame 14 may be provided with an elastic groove 53 and a pressing portion to support the heavy load of the front glass 20 and to firmly maintain a hook fastening structure between the outer frame 14 and the inner frame 19. The pressing portion may include a plurality of pressing ribs 54, connecting ribs 55, and support ribs 56.

An elastic groove 53 may be disposed radially inward from the first hook 51 on the rear surface of the outer frame 14. The elastic groove 53 may be concave in the thickness direction of the flat portion 15 on the rear surface of the flat portion 15 of the outer frame 14. The elastic groove 53 may be more concave in the thickness direction of the flat portion 15 at an inner side of the first hook 51, so as to reduce a thickness of the first hook 51, thereby allowing the first hook 51 to be elastically deformed radially outward.

When the second hook 52 enters an inside of the first hook 51 in the axial direction, the hook protrusion 511 of the first hook 51 may spread outward in the radial direction while the hook protrusion 511 of the first hook 51 and the hook protrusion 521 of the second hook 52 are brought into contact with each other, thereby facilitating the hook protrusion 521 of the second hook 52 to enter an inside of the hook protrusion 511 of the first hook 51. In addition, as a radial pressing force between the hook protrusion 511 of the first hook 51 and the hook protrusion 521 of the second hook 52 is released while the hook protrusion 521 of the second hook 52 passes through a highest point of the hook protrusion 511 of the first hook 51, the first hook 51 is restored to its original position from the deformed position, thereby allowing the hook protrusion 511 of the first hook 51 and the hook protrusion 521 of the second hook 52 to be engaged with each other.

The plurality of pressing ribs 54 may be provided on the rear surface of the flat portion 15. The plurality of pressing ribs 54 may protrude from the rear surface of the flat portion 15 to be brought into contact with an inner circumferential surface of the second hook 52, so as to press the second hook 52 when fastening the first hook 51 and the second hook 52 together. The plurality of pressing ribs 54 may be spaced apart from each other in the circumferential direction of the flat portion 15.

The plurality of pressing ribs 54 presses the inner circumferential surface of the second hook 52 radially outward when the first hook 51 and the second hook 52 are fastened to each other. Accordingly, as the second hook 52 is not pushed inward in the radial direction, a fastening state between the outer frame 14 and the inner frame 19 may be firmly maintained without being axially released from each other after the hook protrusion 511, 521 of each of the first hook 51 and the second hook 52 are fastened to each other. In addition, the plurality of pressing ribs 54 may press the second hook 52, thereby enhancing a coupling force between the outer frame 14 and the inner frame 19. The plurality of pressing ribs 54 may be located radially inward from the elastic grooves 53 on a rear surface of the outer frame 14.

An entry guide surface 541 may be formed to be inclined toward the elastic groove 53 on a rear surface of pressing rib 54. The entry guide surface 541 may guide movement of the second hook 52 so that the second hook 52 is inserted between the pressing rib 54 and the first hook 51. The entry guide surface 541 may facilitate entry of second hook 52 into first hook 51, thereby improving assemblability.

The interference or snap fit of the first and second hooks 51, 52 may function as follows. The first inclined surface of the hook protrusions 511, 521, then the second inclined surfaces of the hook protrusions 511, 521 interact as the second hook 52 enters into the first hook 51, the first hook 51 flexing to accommodate the second hook 52 and the entry guide surface 541 facilitating entry of the second hook 52 into the first hook 51. Once the second hook 52 has entered or been coupled to the first hook 51, the second inclined surfaces as well as the plurality of pressing ribs function to maintain the coupling between the first hook 51 and the second hook 52, and thus, the outer frame 14 and the inner frame 19.

The connecting rib 55 may protrude in a rearward direction from the rear surface of the outer frame 14, and may extend along the circumferential direction in a ring shape. The connecting rib 55 may connect the plurality of pressing ribs 54.

The connecting rib 55 may protrude from an opposite side of first adhesive overflow groove 381 toward the inner frame 19 on the rear surface of the flat portion 15. Some or all of the connecting rib 55 may overlap in the thickness direction the first adhesive overflow groove 381 and the flat portion 15. Accordingly, the connecting rib 55 may reinforce a reduction in rigidity caused by a smaller thickness of one side of the flat portion 15 due to the adhesive overflow groove 381.

The elastic groove 53 may be disposed between the connecting rib 55 and the first hook 51. The elastic groove 53 may have an inner inclined surface formed to be inclined so that the thickness of the flat portion 15 gradually decreases toward the first hook 51 from the connecting rib 55.

The plurality of support ribs 56 may protrude from the rear surface of the outer frame 14. The plurality of support ribs 56 may have a trapezoidal plate structure to vertically extend in the radial direction.

The plurality of support ribs 56 may be spaced apart from each other in the circumferential direction. One or a first side of each of the plurality of support ribs 56 may be integrally connected to the rear surface of the flat portion 15. An outer surface perpendicular to one side of the support ribs 56 may be integrally connected to the connection rib 55, and thus, the plurality of support ribs 56 may be connected to one another by the connection rib 55. The other side or a second of the support rib 56 positioned on a side opposite to the first side of the support rib 56 may be disposed in parallel to the flat portion 15. The plurality of support ribs 56 may be integrally arranged to be in direct contact with an inner surface of the connecting rib 55 and the flat portion 15 so as to firmly support the connecting rib 55 and the pressing ribs 54.

The plurality of pressing ribs 54 and the plurality of support ribs 56 may be disposed at inner and outer sides of the connecting rib 55 to face each other in the radial direction with the connection rib 55 interposed therebetween.

The plurality of support ribs 56 may overlap with each other in the thickness direction of the adhesive groove 37 and the flat portion 15 on the rear surface of the flat portion 15. The support ribs 56 may compensate for weakening of the rigidity of the flat portion 15 due to the adhesive groove 37.

A reinforcing rib 57 may protrude from an opposite side of second adhesive overflow groove 382 disposed at an inner side of the adhesive groove 37 on the rear surface of the flat portion 15. The reinforcing rib 57 may overlap with the second adhesive overflow groove 382 in the thickness direction of the flat portion 15. The support ribs 57 may compensate for weakening of the rigidity of the flat portion 15 due to the adhesive overflow grooves 381,382.

The handle 35, which is part of the inner frame 19, may be thinner than other portions of an outer edge of the inner frame 19 (portions other than the handle 35). The handle 35 does not axially cover an outer surface of the first hook 51 of the outer frame 14.

The handle 35 may have a plate shape. The handle 35 may be inclined to be thicker from an inner side toward an outer side of the inner frame 19 in the radial direction. The handle 35 may be inclined to be thicker from an inner side toward an outer side of the handle 35 in the radial direction, preventing fingers from sliding outward on the rear surface of the handle 35, when the user pulls the handle 35.

A handle pad 351 may be attached to the rear surface of the handle 35. The handle pad 351 may have a constant thickness. The handle pad 351 may be made of a rubber material, for example. The handle pad 351 may prevent a user's hand from slipping.

A tapered portion may be formed to be inclined at an outer side of the handle pad 351 in the radial direction. An end portion or end of the tapered portion may correspond to a rear end portion or end of first hook 61. A step between the first hook 61 of the outer frame 14 and the tapered portion of the handle pad 351 may be eliminated, allowing the user to put fingers into the rear surface of the handle 35 easier for pulling the handle 35. Further, a simpler appearance of the outer frame 14 and the handle 35 may be achieved.

A hook coupling structure between the handle 35 and the outer frame 14 is somewhat different from the hook coupling structure between the inner frame 19 and the outer frame 14. A plurality of second hooks 62 of the handle 35 may be spaced apart from each other in the circumferential direction of the handle 35. Each of the plurality of second hooks 62 provided on the handle 35 may have different lengths in the circumferential direction.

The first hook 61 of the outer frame 14 and the second hook 62 of the handle 35 may protrude in parallel to each other in the radial direction. The first hook 61 of the outer frame 14 may protrude radially inward from the inner circumferential surface of the outer frame 14, and the second hook 62 of the handle 35 may protrude radially outward from an outer circumferential surface of the handle 35. The first hook 61 of the outer frame 14 and the second hook 62 of the handle 35 may overlap in a thickness direction of the handle 35 to engage with each other in the thickness direction when the outer frame 14 and the inner frame 19 are coupled to each other in an engaged manner.

A chamfer 611 may be formed at an edge of one or a first side of the first hook 61 to be inclined at a predetermined angle. A contact portion 612 may be disposed substantially vertically at the other or a second side of the first hook 61.

A chamfer 621 may be formed at an edge of one or a first side of the second hook 62 of the handle 35 to be inclined at a predetermined angle. The contact portion 622 may be formed substantially vertically at the other or a second side of the second hook 62 of the handle 35.

When the outer frame 14 and the inner frame 19 are coupled to each other in a frontward-rearward direction (axial direction), the chamfers 611, 612 are in contact with each other, thereby facilitating the second hook 62 of the handle 35 to enter an inside of the first hook 61 of the outer frame 14.

In addition, subsequent to coupling the outer frame 14 and the handle 35, the first and second contact portions 612 and 622 of each of the first hook 61 of the outer frame 14 and the second hook 62 of the handle 35 are in contact with each other substantially vertically, thereby preventing them from being released from each other.

The elastic groove 53 may be concave in the thickness direction on the rear surface of the flat portion 15 of the outer frame 14, and thus, the first hook 61 may be elastically deformable radially outward by the elastic groove 53 when the first hook 61 is inserted into and coupled to an inside of the second hook 62. Moreover, the second hook 62 may easily enter an inside of the first hook 61 by the chamfers 611 and 621, and the first hook 61 and the second hook 62 may be prevented from being released from each other by the contact portions 612 and 622.

The reinforcing rib 60 may protrude toward the first adhesive overflow groove 381 at one side of the handle 35. The reinforcing rib 60 may be disposed to be in contact with an opposite side of the first adhesive overflow groove 381. The reinforcing rib 60 of the handle 35 may compensate for weakening of a strength of the flat portion 15 caused by a smaller thickness of the flat portion 15 due to the second adhesive overflow groove 382.

In addition, the reinforcing rib 60 may serve as a spacer for maintaining a constant gap between the handle 35 and the flat portion 15, thereby reducing the thickness of the handle 35. Moreover, the reinforcing rib 60 may not only reinforce the strength of the handle 35 even when the thickness of the handle 35 is reduced, but also maintain a contact state between the contact portion 612 of the first hook 61 and the contact portion 622 of the second hook 62. Accordingly, coupling and assembly performance between the outer frame 14 and the inner frame 19 may be improved by a coupling structure between the first hook 61 of the outer frame 14 and the second hook 62 of the handle 35.

Embodiments disclosed herein solve those problems of the related art. Embodiments disclosed herein provide a laundry treating apparatus capable of preventing a hand from slipping off a handle of a door frame. Embodiments disclosed herein also provide a laundry treating apparatus capable of preventing a handle of a door frame from being cold due to heat transferred from the door frame, so as to prevent discomfort.

Embodiments disclosed herein provide a laundry treating apparatus that may include a main body provided with a laundry inlet port at a front surface thereof, a door rotatably mounted to the front surface of the main body to open and close the laundry inlet port, a front glass installed at a front surface of the door, and a handle installed at one side of a rear surface of the door, so as to be disposed in a direction opposite to the front glass. The handle may be disposed to be inclined with respect to a vertical plane of the front glass, so as to prevent fingers from sliding outward on the rear surface of the door. The front glass may have a circular shape.

The handle may be made of a rubber material. Further, the handle may have a constant thickness, and be disposed to be inclined toward the rear of the door.

The door may be provided with a door frame having a ring shape. The door frame may include an outer frame having the front glass mounted to a front surface thereof and an inner frame coupled to a rear surface of the outer frame and having the handle mounted thereto.

A chromium layer may be formed on the front surface and a circumferential portion of the outer frame.

The handle mounting portion may be recessed into an upper side of a rear surface of the inner frame. The handle mounting portion may be inclined to be thicker toward an outer side of the door in a radial direction of the door. The handle may further include a tapered portion tapered at one end portion of a rear surface of the handle, so as to be thinner toward an outer circumferential end of the door.

Embodiments disclosed herein provide a laundry treating apparatus that may include a main body provided with a laundry inlet port at a front surface thereof, a door rotatably mounted to the front surface of the main body to open and close the laundry inlet port, a front glass installed at a front surface of the door, and a handle installed on one side of a rear surface of the door, so as to be disposed in a direction opposite to the front glass. The handle may be inclined to be thicker toward an outer side of the door in a radial direction of the door, so as to prevent fingers from sliding outward on the rear surface of the door. The handle may further include a tapered portion tapered at one end portion or end of a rear surface of the handle, so as to be thinner toward an outer circumferential end of the door.

Embodiments disclosed herein provide a laundry treating apparatus that may include a main body provided with a laundry inlet port at a front surface thereof, a door rotatably mounted to the front surface of the main body to open and close the laundry inlet port, a front glass installed at a front surface of the door, and a handle installed on one side of a rear surface of the door, so as to be disposed in a direction opposite to the front glass. The handle may be provided with a plurality of protrusions on a rear surface thereof to prevent fingers from sliding outward on the rear surface of the door.

Embodiments disclosed herein provide a laundry treating apparatus that may include a main body provided with a laundry inlet port at a front surface thereof, a door rotatably mounted to the front surface of the main body to open and close the laundry inlet port, a front glass installed at a front surface of the door, and a handle installed on one side of a rear surface of the door, so as to be disposed in a direction opposite to the front glass. The handle may be provided with a plurality of grooves on a rear surface thereof to prevent fingers from sliding outward on the rear surface of the door.

Embodiments disclosed herein provide a laundry treating apparatus that may include a main body provided with a laundry inlet port at a front surface thereof, a door rotatably mounted to the front surface of the main body to open and close the laundry inlet port, a front glass installed at a front surface of the door, a handle installed on one side of a rear surface of the door, so as to be disposed in a direction opposite to the front glass. The handle may extend from a rear surface of a door frame to be elastically bent, so as to prevent fingers from sliding outward on the rear surface of the door.

The handle may be integrally formed with the door frame, and an end thereof may be spaced apart from the rear surface of the door frame, so as to be elastically bent in a direction of pulling the door with a hand. The front glass may have front and rear surfaces both formed flat.

With embodiments disclosed herein, in a door with a front glass installed on a front surface of a door frame, a handle may be mounted on a rear surface of the door frame, and be disposed to be inclined backward with respect to a vertical plane of the front glass, thereby preventing fingers from sliding outward on the rear surface of the door.

The handle may be made of a rubber material, thereby giving a soft feeling without giving any uncomfortable feeling to users, and giving a better grip. Further, even if a thickness of the handle is constantly maintained by adjusting a thickness of a handle mounting portion, which is a part of an inner frame, the handle may be disposed to be inclined backward with respect to a vertical plane of the front glass, thereby easily managing a thickness of the handle made of the rubber material.

A chromium layer may be formed on front and outer circumferential surfaces of the outer frame by coating the outer frame with a silver polished metal color, allowing the chromium layer to look like circular droplets with a bright silver color. In addition, the chromium layer may give a luxurious look when viewed with the naked eye.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body having a laundry inlet port at a front surface thereof; and a door rotatably coupled to the front surface of the main body to open and close the laundry inlet port, wherein the door comprises:

an outer frame disposed toward an outside of the main body;

a front glass coupled to a front surface of the outer frame;

an inner frame coupled to a rear surface of the outer frame;

a handle mounting portion that is recessed at a rear surface of the inner frame;

a handle mounted in the handle mounting portion; and a protruding portion that protrudes from an outer circumferential portion of the outer frame to surround an outer edge of the handle mounting portion, wherein the outer frame has a flat portion to which the front glass is coupled, and wherein the handle mounting portion comprises:

a portion formed to protrude from a front surface of the handle mounting portion, and in contact with a rear surface of the flat portion of the outer frame; and a rear surface on which the handle is mounted, and formed to be inclined with respect to the flat portion.

2. The apparatus of claim 1, wherein the front glass has a circular shape.

3. The apparatus of claim 1, wherein the handle is made of a rubber material.

4. The apparatus of claim 1, wherein the handle has a constant thickness, and is inclined toward a rear of the door.

5. The apparatus of claim 1, wherein the door includes a door frame having a ring shape, and wherein the door frame comprises:

the outer frame having the front glass mounted to the front surface thereof; and the inner frame coupled to the rear surface of the outer frame and the handle mounted thereto.

6. The apparatus of claim 5, wherein a chromium layer is formed on the front surface and a circumferential portion of the outer frame.

7. The apparatus of claim 5, wherein the handle mounting portion is recessed into an upper side of the rear surface of the inner frame.

8. The apparatus of claim 1, wherein the handle further comprises a tapered portion tapered at a first end portion of a rear surface of the handle, so as to be thinner toward an outer circumferential end of the door.

9. The apparatus of claim 1, wherein the handle is installed at an upper portion of the rear surface of the door.

10. The apparatus of claim 1, wherein the handle is provided with a plurality of protrusions on a rear surface thereof.

11. The apparatus of claim 1, wherein the handle is provided with a plurality of grooves on a rear surface thereof.

12. The apparatus of claim 1, wherein the front glass has front and rear surfaces both of which are flat.

13. The apparatus of claim 1, wherein the handle mounting portion is inclined to be thicker toward an outer side of the door in a radial direction of the door.

14. The apparatus of claim 1, wherein a protrusion length of the protruding portion corresponds to a sum of a thickness of the handle mounting portion and a thickness of an outer end of the handle.

15. The apparatus of claim 1, wherein a protrusion length of the protruding portion is longer than a thickness of the handle mounting portion.

* * * * *